US005623982A

United States Patent [19]

Okazaki

[11] Patent Number: 5,623,982

[45] Date of Patent: Apr. 29, 1997

[54] PULL CORD STOPPER DEVICE FOR USE IN A BLIND APPARATUS

[75] Inventor: Fumiko Okazaki, Tokyo, Japan

[73] Assignee: Kabushiki Kaisha Nichibei, Tokyo, Japan

[21] Appl. No.: 353,117

[22] Filed: Dec. 9, 1994

[51] Int. Cl.[6] ..... E06B 9/324

[52] U.S. Cl. ..... 160/178.2; 24/136 A

[58] Field of Search ..... 160/178.2 R, 168.1 R, 160/173 R, 176.1 R, 178.1 R, 166.1 R; 24/136 A, 136 R, 115 L, 115 M

[56] References Cited

U.S. PATENT DOCUMENTS

| | | | |
|---|---|---|---|
| 4,180,118 | 12/1979 | Vecchiarelli . | |
| 4,947,921 | 8/1990 | Chun-Cheng . | |
| 5,143,135 | 9/1992 | Kuhar | 160/178.2 R |
| 5,156,196 | 10/1992 | Corey et al. | 160/178.2 R |
| 5,263,528 | 11/1993 | Patel | 160/178.2 R |
| 5,275,222 | 1/1994 | Jelic et al. | 160/178.2 R |

FOREIGN PATENT DOCUMENTS

| | | |
|---|---|---|
| 6117170 | 4/1994 | Japan . |
| 6200686 | 7/1994 | Japan . |
| 6200688 | 7/1994 | Japan . |

*Primary Examiner*—David M. Purol
*Attorney, Agent, or Firm*—McAulay Fisher Nissen Goldberg & Kiel, LLP

[57] ABSTRACT

A pull cord stopper device (20) for use in a blind apparatus operative in response only to a cord control string attached to pull cords. The pull cord stopper device (20) is disposed in a head box (10) and is adaptive to a large-scale blind apparatus. A stopper case (28) of the pull cord stopper device (20) comprises a comb portion (40) for separating the pull cords (16), a knurled portion (42) for guiding a pinch roller (30), and a pin (54) received in a guide groove (52) formed in a switch member(34), for guiding the movement of the switch member (34). A slidable block (32) rotatably supports the pinch roller (30), and is operative to move within the stopper case (28) in the direction of movement of the pull cords (16) as a result of a rotation of the pinch roller (30). The slidable block (32) supports the switch member (34) which is integrally movable with the pull cords (16) in a direction of its travel, and, at the same time, supports the switch member (34) in a manner that it is relatively movable in a direction transverse to the travel of the pull cords (16). A resilient member (36) is operative to restrain the pull cords (16) by pinching them between a pressure member (38) and the pinch roller (30). The resilient member (36) constantly urges the slidable block (32) such that the pull cords (16) are pinched between the pinch roller 30 and the pressure member (38).

5 Claims, 20 Drawing Sheets

PULL CORD STOPPER DEVICE FOR USE IN A BLIND APPARATUS

BACKGROUND OF THE INVENTION

1. Field of the Invention

The present invention relates to a pull cord stopper device for pleated blinds or Roman shades which are frequently raised or lowered.

2. Description of the Related Art

A conventional pull cord stopper device for use in a blind apparatus has been disclosed in Japanese Utility Model Application Hei-63-201199. The conventional pull cord stopper device according to this disclosure is mounted in a head box and is of a type that controls pull cords that are routed through the head box and extend out of one end of the head box.

The device according to this disclosure includes a stopper roller which is designed to maintain contact with the pull cords, where the stopper is rotatably supported by a guide member positioned on a floating axis which is perpendicular to a direction in which the the pull cords are routed. The device also includes a stopper case which supports the stopper roller and which has on its bottom surface a rotating contact face with the stopper roller. A loop-like guide groove is formed on the side walls of the stopper case above the rotating contact face. A stopper pin is disposed at a predetermined distance apart from the guide groove and between the side walls. Also provided is a restraint contact portion which is extended in parallel with the floating axis and which is radially apart from the guide member on the floating axis beyond the radius of the stopper roller. The restraint contact portion prevents the guide pin from sliding back in the loop guide in the stopper case. When a user exerts a force on the pull cords, the guide pin is caught by the restraint contact portion. When the force is removed after advancing the pull cords by some distance, the guide pin reverts back to its original position after one round of travel in the loop groove.

In the conventional pull cord stopper device, the width of the head box is subject to space limitations. When a large number of pull cords are used, some of the cords are stacked given the difficult to evenly space all the pull cords. In particular, when this occurs the pull cords are horizontally arranged across the width of the stopper device, thereby making it necessary to exploit the full width of the head box. Since the loop-like guide groove is formed on the side wall of the stopper case, the available inner width of the stopper case is limited. As a result, the number of the pull cords that can be used in a conventional device is limited. The loop-like guide groove formed on the side wall of the stopper case requires that the stopper case be high enough to accommodate the loop-like guide groove. The height of the stopper case is therefore required to be an undesirably large dimension.

The above problems may be resolved by allowing a slidable block to slide by means of the rotation of a pinch roller and a friction with the pull cords in order to suspend or release the pull cords. The pull cord stopper device of this type, however, also has certain problems—an aborted or insufficient travel of the slidable block, tangled pull cords, and an inevitable wear of the pull cords.

SUMMARY OF THE INVENTION

It is an object of the present invention to provide an overall solution to each of the above described problems. To achieve these objects, the present invention is characterized in that a plurality of pull cords are routed in parallel through the stopper device to increase the frictional surface between the pull cords and the pinch roller and keep the pull cords free from mutual entanglement, and that a fully idle rotation range of the pinch roller is set up within the travel of the pinch roller to minimize the wear rate of the pull cords.

Referring to the various reference numerals in the drawings, to achieve each of the above-discussed objects, the pull cord stopper device for use in a blind apparatus according to the present invention includes: a head box (10); a screen (12), a top of which is connected to the head box (10); a bottom weight (14) connected to the bottom of the screen (12); pull cords (16), the ends of which are connected to the bottom weight (14), and the other ends of which are routed along the screen (12), or routed by through-holes (18) disposed in the screen (12), then introduced into a head box (10) in a manner that the pull cords are operative to be raised or lowered, and then delivered out of one end of the head box (10); and a pull cord stopper device (20) capable of restraining movement of the pull cords (16).

The pull cord stopper device (20) comprises a stopper case (28), a pinch roller (30), a slidable block (32), a switch member (34) and a pressure member (38). The stopper case (28) comprises a separation portion (40) for separating the pull cords (16) from one another; a knurled portion (42) for guiding a movement of the pinch roller (30); and a pin (54) received by a guide groove (52) formed on the switch member (34) for guiding the switch member (34).

In this configuration, the slidable block (32) rotatably supports the pinch roller (30) and is operative to move in the direction of movement of the pull cords (16) by means of rotation of the pinch roller (30). The slidable block (32) also supports the switch member (34) which is integrally movable with the pull cords (16) in its direction of movement and, at the same time, movable in a direction transverse to the movement of the pull cords (16). Also, the pressure member (38) is adaptable to pinch the pull cords (16) between the pinch roller (30) and the pressure member (38).

In accordance with another aspect of the invention, a pull cord stopper device for use in a blind apparatus includes a stopper case (62), a pinch roller (64), a slidable block (66), a switch member (68) and a pressure member (70). In this configuration, the stopper case (62) comprises a separation portion (72) for separating the pull cords (16) from one another; a knurled portion (74) for guiding a movement of the pinch roller (64); and a cutout portion (75) for allowing the pinch roller (64) to idly rotate.

In this embodiment of the invention, the slidable block (66) rotatably supports the pinch roller (64), and is operative to move in the direction of travel of the pull cords by means of rotation of the pinch roller (64) and contact with the pull cords (16). The slidable block (66) also supports the switch member (68) which is integrally movable with the pull cords (16) in its direction of travel and, at the same time, movable in a direction transverse to the travel of the pull cords (16).

The switch member (68) is provided with a guide groove (82). The guide groove (82) receives a pin (76) rigidly connected to the stopper case (62) for guiding the movement of the switch member (68) and the pressure member (70) is operative to pinch the pull cords (16) between the pinch roller (64) and the pressure member (70).

The pin may be constantly urged by a resilient member toward the groove of the switch member. Also, a resilient member may be provided to constantly urge the pressure member (66) in a manner that allows the pull cords (16) to be pinched between the pressure roller (64) and the pressure member (70). Also, the pressure member may be detachably mounted on the stopper case.

When the pull cords are pinched between the pinch roller and the pressure roller, a cord control string is pulled downward, the pinch roller rotates, is guided by the knurled portion, and moves along with the slidable block in the direction of movement of the pull cords. Along with the slidable block, the switch member moves until the pin reaches a predetermined position in the guide groove. When the pin reaches the predetermined position in the guide groove, the switch member is restrained, and thus movement of the slidable block stops. Since the pinch roller is now spaced apart from the pinching face of the pressure member, the pull cords are not engaged between the pinch roller and the pressure member, and are free to move. The pull cord control string can thus be pulled continuously downward and the screen can be is raised.

When a user releases his or her hold of the pull cord control string, the pull cords move in the opposite direction because of the mass of the bottom weight. This movement causes the pinch roller to rotate in the direction opposite to the first rotational direction above, and the pinch roller is again guided by the knurled portion. Along with the slidable block, the switch member moves in the opposite direction until the pin reaches a predetermined position in the guide groove. When the pin reaches the predetermined position in the guide groove, the movement of switch member is restrained, and the slidable block is prevented from further movement. In this position, the pinch roller is now spaced apart from the pinching face of the pressure member and the pull cords are not pinched between the pinch roller and the pinching face of the pressure member. Thus, the pull cords are free to move, and continuously move by the mass of the bottom weight. The screen thus goes downward.

Again the pull cord control string is manually pulled downward, and the pull cords move in the direction of movement of the pull cords. The pinch roller rotates, the slidable block moves in the direction of the movement of the pull cords, and the pin moves to another predetermined position in the guide groove. The movement of the switch member is restrained by the pin, and the slidable block stops.

Operationally, when a user releases his or her hold of the control string, the pull cords move because of the mass of the bottom weight. This movement causes the pinch roller to rotate and to move over the knurled portion, along with the slidable block. The movement of the slidable block causes the switch member to move until the pin reaches a predetermined position in the guide groove. When the pin reaches the predetermined position in the guide groove, the movement of the switch member is restrained, and the slidable block cannot continue its movement. Since the pinch roller is at the knurled portion, the pull cords are pinched between the pinch roller and the pressure member, the pull cords are restrained.

The switching operation of the subject invention may be controlled by pulling the cord control string. The slidable block is moved by the pinching roller being guided over the knurled portion during a predetermined portion of its travel path. During the rest of its travel path, the slidable block is moved by means of friction with the pull cords. This switching operation of the invention is controlled by releasing and pulling of the cord control string.

Entanglement of the pull cords is prevented by allowing the separation portion to separate the pull cords from one another.

DETAILED DESCRIPTION OF THE PREFERRED EMBODIMENTS

Figure 1:
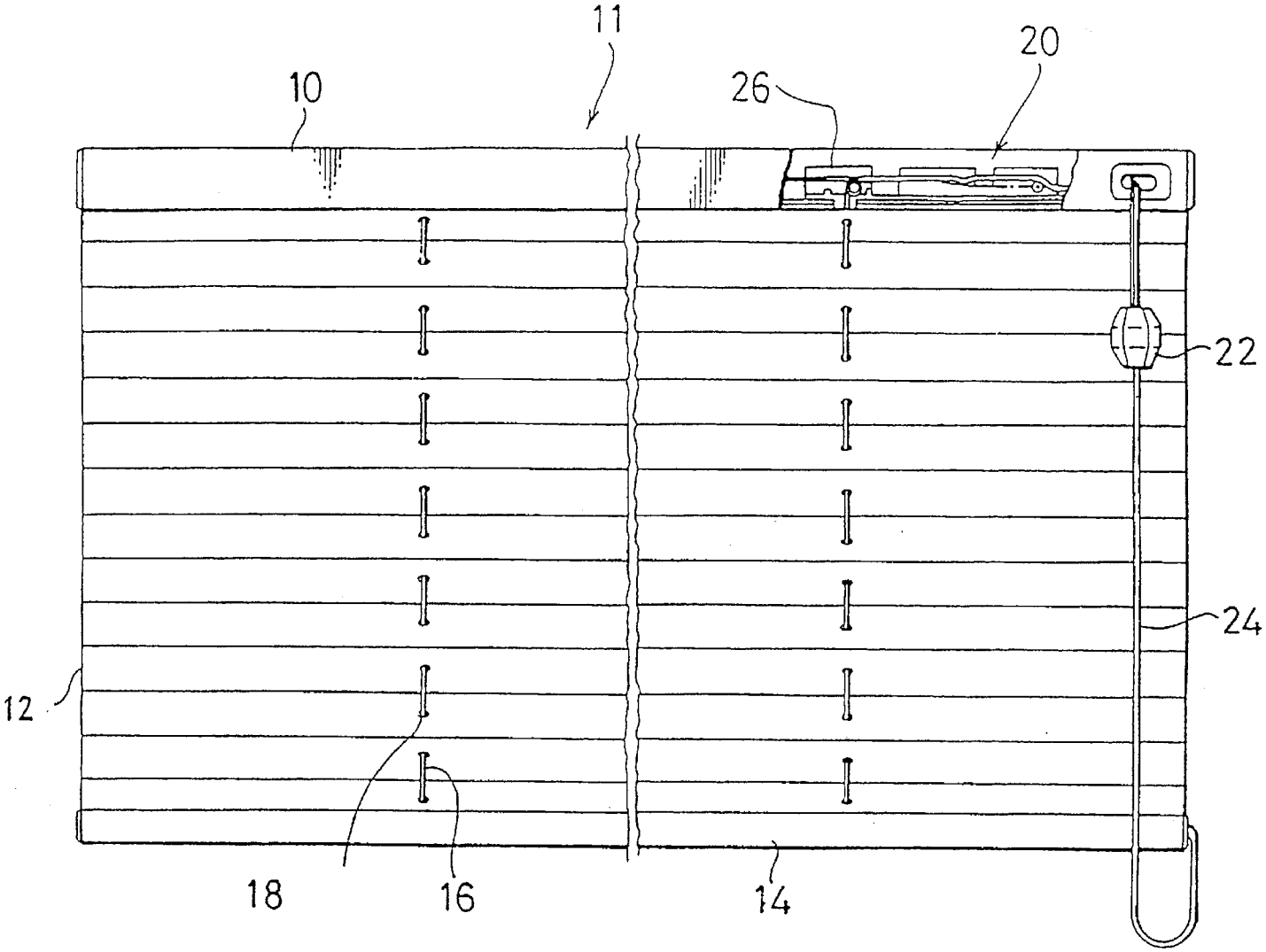
FIG. 1 shows generally a blind apparatus according to the present invention.

FIG. 1 shows a blind apparatus 11 according to the present invention. In FIG. 1, a top edge of a screen 12 is connected to a bottom side of a head box 10. A bottom weight 14 is connected to the bottom edge of the screen 12. An end of each pull cord 16 is routed vertically through holes 18 disposed in the screen 12, and then introduced into the head box 10. The pull cords 16 are then positioned horizontally along a cord guide 26. Upon reaching a right-hand end of the head box 10, the pull cords 16 are passed through a pull cord stopper device 20 which can stop the movement of the pull cords 16. The pull cords 16 are then routed out of the head box 10.

The end of each pull cord 16 extended from the head box 10 is connected to a cord binder 22. Also connected to the cord binder 22 is one end of a cord control string 24 which is operative to raise or lower the pull cord 16. The other end of the cord control string 24 is connected to one side of the bottom weight 14.

Figure 2:
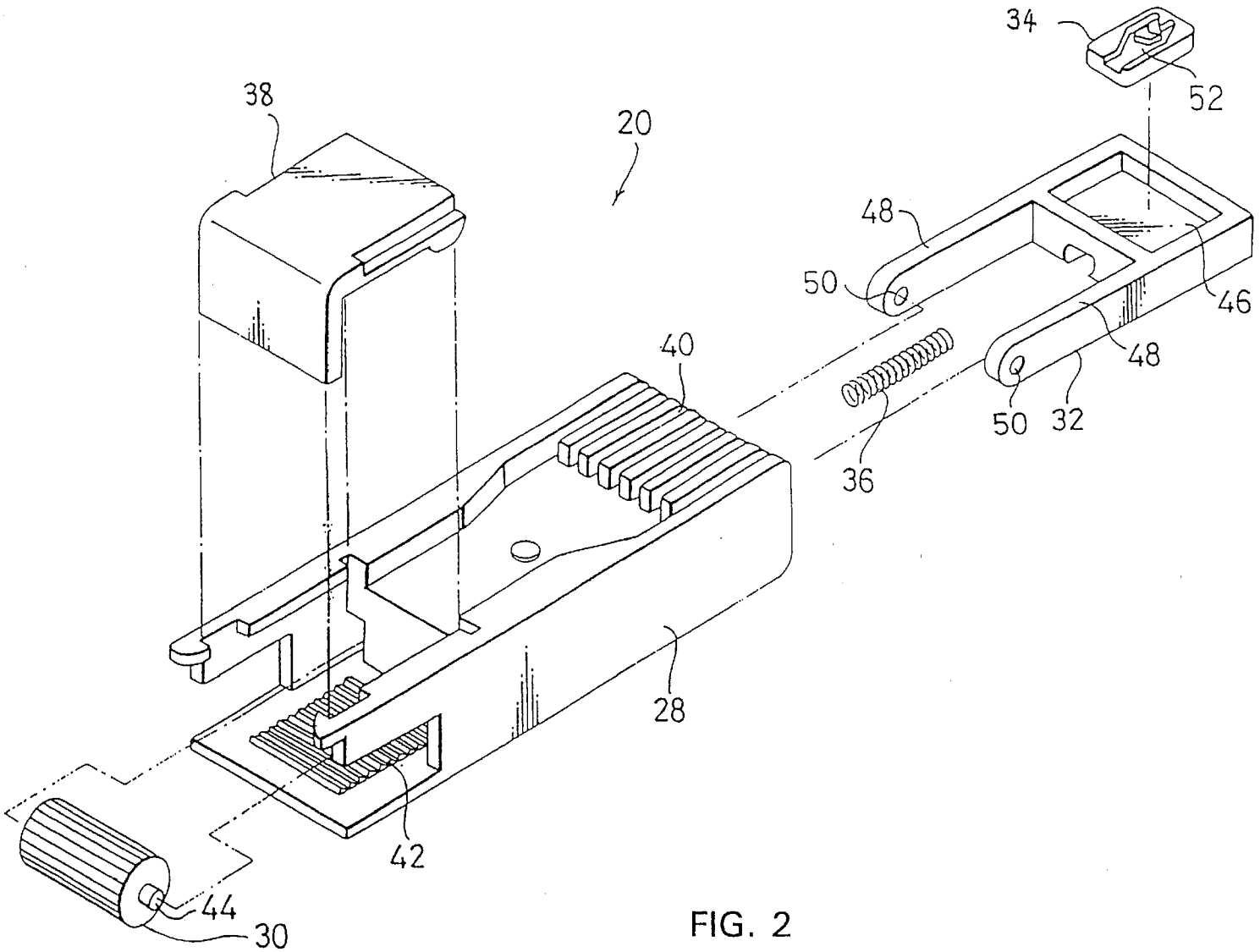
FIG. 2 is an exploded perspective view showing the pull stopper device according to a first embodiment of the present invention.
Figure 3:
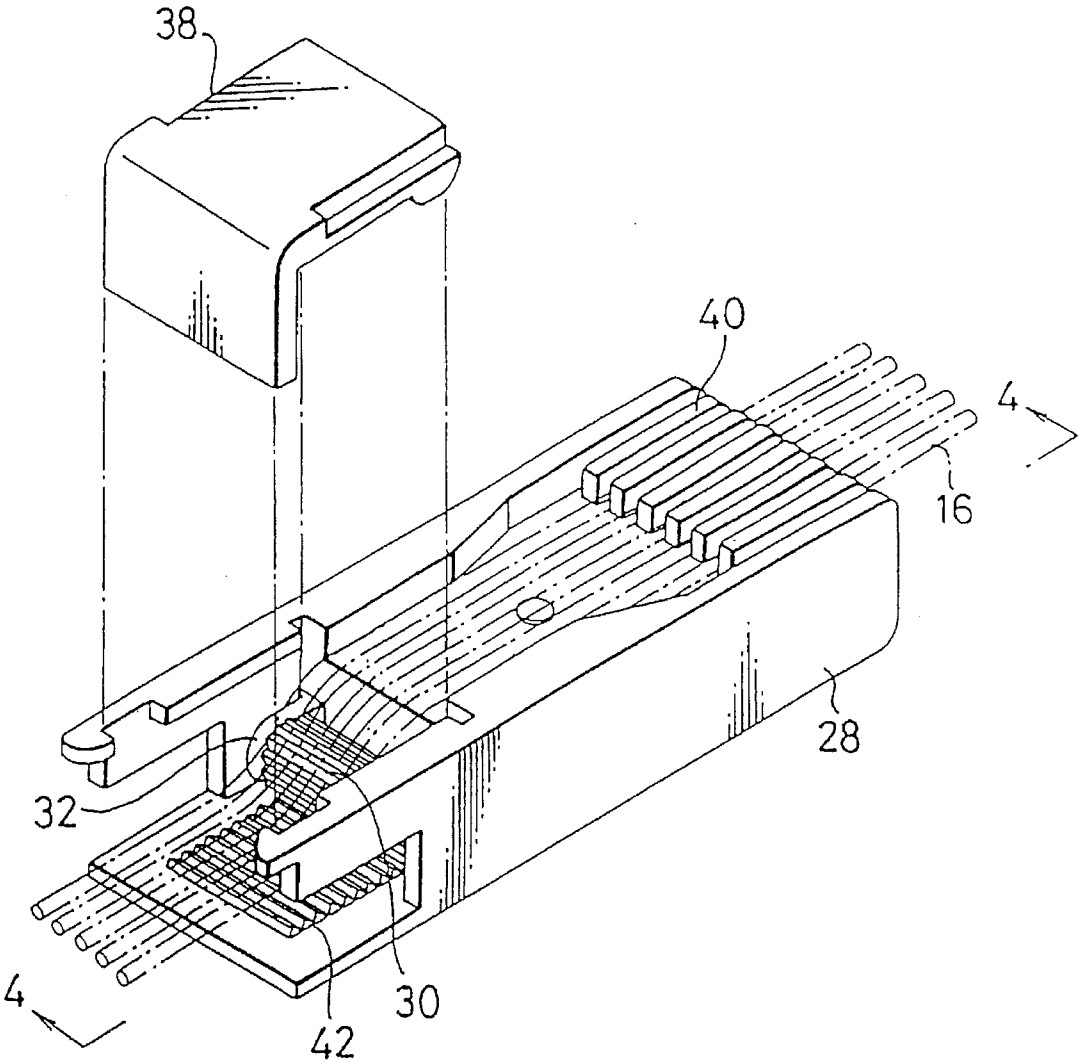
FIG. 3 is a perspective view showing an assembled stopper device.

FIG. 2 is an exploded perspective view of a pull cord stopper device 20 according to the present invention. The pull cord stopper device 20 comprises a stopper case 28, a pinch roller 30, a slidable block 32, a switch member 34, a resilient member 36, and a pressure member 38. The stopper case 28 has on its one end a comb portion 40 where longitudinally extending recesses and projections are alternated. As shown in FIG. 3, each recess of the comb portion 40 allows one cord to pass therethrough, separating the pull cords 16. The stopper case 28 has positioned on its other end a knurled portion 42 where transversely extending sawtooth projections are provided. The sawtooth projection of the knurled portion 42 is meshed with the sawtooth projections positioned along a circumference of the pinch roller 30, causing the pinch roller 30 to move.

Figure 5:
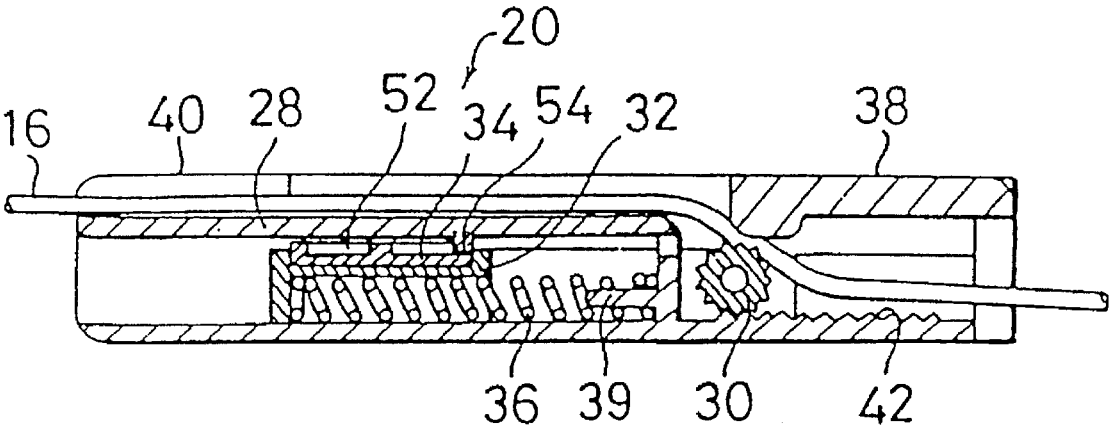
FIG. 5 is a cross-sectional view showing a stopper device which restrains movement of pull cords.

The stopper case 28, as is best seen from FIG. 5, has a pin 54 projected downward from a top inner wall. Referring again to FIG. 2, the pinch roller 30 has on both of its ends projections 44. The slidable block 32 includes a support 46 for supporting the switch member 34 and arms 48 extended from both ends of the support 46. The end portion of each arm 48 has a through-hole 50 that rotatably receives and supports the projection 44 of the pinch roller 30.

Figure 4:
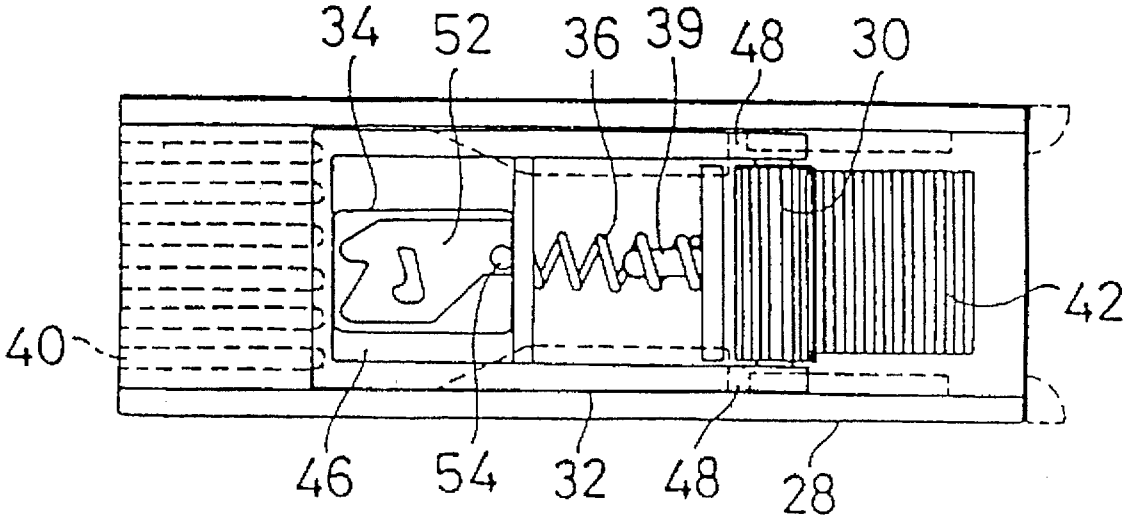
FIG. 4 is a cross-sectional view taken along line 4—4 in FIG. 3.

The pressure member 38 is mounted over the knurled portion 42 of the stopper case 28. Referring to FIG. 4, the pressure member 38 has a projection 39 extended toward the comb portion 40 of the stopper case 28. The resilient member 36, which on its one end is engaged with the projection 39 of the pressure member 38, is disposed between the pressure member 38 and the slidable block 32. The resilient member 36 constantly urges the slidable block 32 so that the pull cords 16 are pressed between the pinch roller 30 and the pressure member 38. The switch member 34 is provided with a guide groove 52 on its top surface.

FIG. 3 is a perspective view showing an assembled pull cord stopper device 20, and FIG. 4 is a cross-sectional view taken along line 4—4 of FIG. 3. The slidable block 32 is inserted into the stopper case under its comb portion 40 in a manner that the arms 48 of the slidable block 32 come toward the knurled portion 42. The pinch roller 30 is mounted on the arms 48 with its projections 44 rotatably received at the through-holes 50. The pinch roller 30 is engaged with the stopper case 28. That is, the knurled portion 42 of the stopper case 28 is meshed with the circumferential sawteeth on the pinch roller 30. When the pinch roller 30 rotates, the pinch roller 30 along with the slidable block 32 move in the longitudinal direction of the stopper case 28. When the pinch roller 30 reaches the end of the knurled portion 42 at the comb portion 40 side, the pinch roller 30 presses the pull cords 16 against a pinching face of the pressure member 38, and thus restrains the motion of the pull cords 16.

As was already described, the resilient member 36 is disposed between the slidable block 32 and the pressure member 38. The switch member 34 is mounted, with its guide groove 52 facing upward, within the support 46 of the slidable block 32. As shown in FIG. 4, the switch member 34 is slidable in a direction perpendicular to the direction of motion of the slidable block 32. The guide groove 52 receives the pin 54 in a manner that allows the switch member 34 to move. The pull cords 16 enter the stopper case 28 with each routed through the corresponding recess of the comb portion 40, pass on top of the middle portion of stopper case 28 and on the pinch roller 30, and then exit the stopper case 28.

The operation of this embodiment of the present invention is now discussed.

Figure 7:
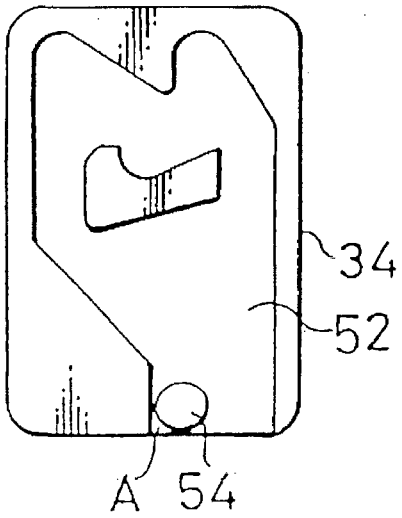
FIG. 7 is a top view showing a pin which is located at position A in a guide groove of a switch member.

Referring to FIG. 5, when the blind apparatus 11 is stationary, the slidable block 32 of the pull cord stopper device 20 is positioned to the left of the device. Referring to FIG. 7, when the pin 54 is caught by a position A of the guide groove 52 of the switch member 34, the slidable block 32 begins to move to the right. The pinch roller 30 then becomes positioned at the left-hand end of the knurled portion 42, and presses the pull cords 16 against the pressure member 38.

Figure 8:
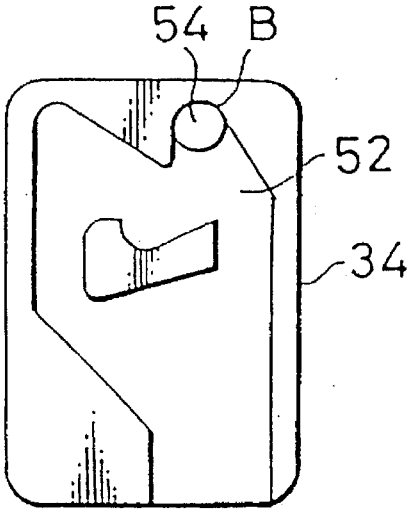
FIG. 8 is a top view showing a pin which is located at position B in a guide groove of a switch member.

Referring to FIG. 5, when a user exerts a downward force on the pull cord control string 24, the pull cord 16 moves to the right. This pulling motion causes the pinch roller 30 to rotate clockwise and therefore move rightward by means of the knurled portion 42. Along with the pinch roller 30, the slidable block 32 moves rightward as well. Also, along with the slidable block 32, the switch member 34 moves rightward and downward until, as shown in FIG. 8, the pin 54 reaches a position B of the guide groove 52. When the pin 54 reaches the position B of the guide groove 52, the rightward movement of the switch member 34 is restrained and the slidable block 32 is stopped.

When this occurs, the pinch roller 30 is positioned away from the pinching face of the pressure member 38. The pull cords 16 are therefore disengaged from contact by the pinch roller 30 and the pinching face of the pressure member 38, and the control string 24 is now free to be pulled downward. This further pulling motion allows the screen 12 to be raised.

Figure 6:
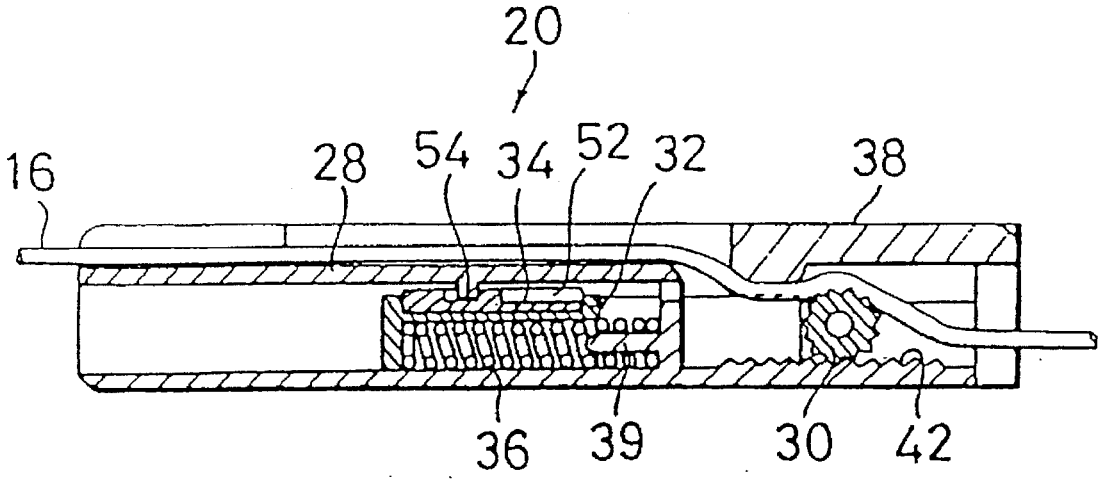
FIG. 6 is cross-sectional view showing a stopper device which allows movement of pull cords.
Figure 9:
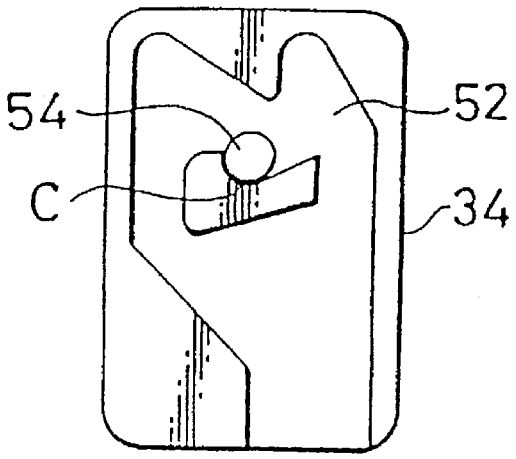
FIG. 9 is a top view showing a pin which is located at position C in a guide groove of a switch member.

When a user releases his or her hold of the control string 24, the pull cords 16 move leftward, as shown in FIG. 6, because of the mass of the bottom weight 14. This movement causes the pinch roller 30 to rotate counterclockwise and move leftward by means the knurled portion 42. Since the slidable block 32 is under the urging of the resilient member 36, the slidable block 32 continues to move leftward. Along with the slidable block 32, the switch member 34 moves leftward and upward as well until, as shown in FIG. 9, the pin 54 reaches a position C of the guide groove 52. When the pin 54 reaches the position C of the guide groove 52, the leftward movement of the switch member 34 is restrained, and the slidable block 32 is stopped.

As shown in FIG. 6, when this occurs, the pinch roller 30 is spaced apart from the pinching face of the pressure member 38 such that the pull cords 16 are not pinched between the pinch roller 30 and the pressure member 38. Thus, the pull cords 16 are free to move, and continuously move leftward given the mass of the bottom weight 14. This results in the screen 12 moving downward.

Figure 10:
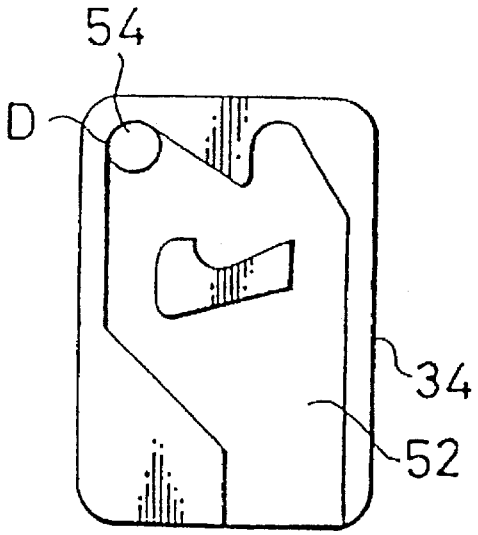
FIG. 10 is a top view showing a pin which is is located at position D in a guide groove of a switch member.

Again referring to FIG. 6, when the control string 24 is manually pulled downward, the pull cords 16 move rightward. This causes the pinch roller 30 to rotate clockwise, and move rightward as well by means of the knurled portion 42. Along with the pinch roller 30, the slidable block 32 also moves rightward. The rightward movement of the slidable block 32 causes the switch member 34 to move rightward and upward as well until, as shown in FIG. 10, the pin 54 reaches a position D of the guide groove 52. When the pin 54 reaches the position D of the guide groove 52, the rightward movement of the switch member 34 is restrained. As a result, the slidable block 32 is stopped.

When a user releases his or her hold of the control string 24, again referring to FIG. 6, the pull cords 16 move leftward because of the mass of the bottom weight 14. This movement causes the pinch roller 30 to rotate counterclockwise and to move leftward as well by means of the knurled portion 42. Since the slidable block 32 is under the urging of the resilient member 36, the slidable block 32 continues to move leftward. Along with the slidable block 32, the switch member 34 moves leftward and downward as well until, as shown in FIG. 7, the pin 54 reaches the position A of the guide groove 52. When the pin 54 reaches the position A of the guide groove 52, the leftward movement of the switch member 34 is restrained, and the slidable block 32 cannot continue its leftward movement.

When this occurs, referring to FIG. 5, the slidable block 32 stops. Namely, the pinch roller 30 is at the left end of the knurled portion 42, and the pull cords 16 are pinched between the pinch roller 30 and the pressure member 38, restraining the motion of the cords 16.

As described above, the pull cord stopper device 20 can switch between engagement and disengagement of the pull cords 16 depending on the number of times the control string has been pulled by a user.

Figure 11:
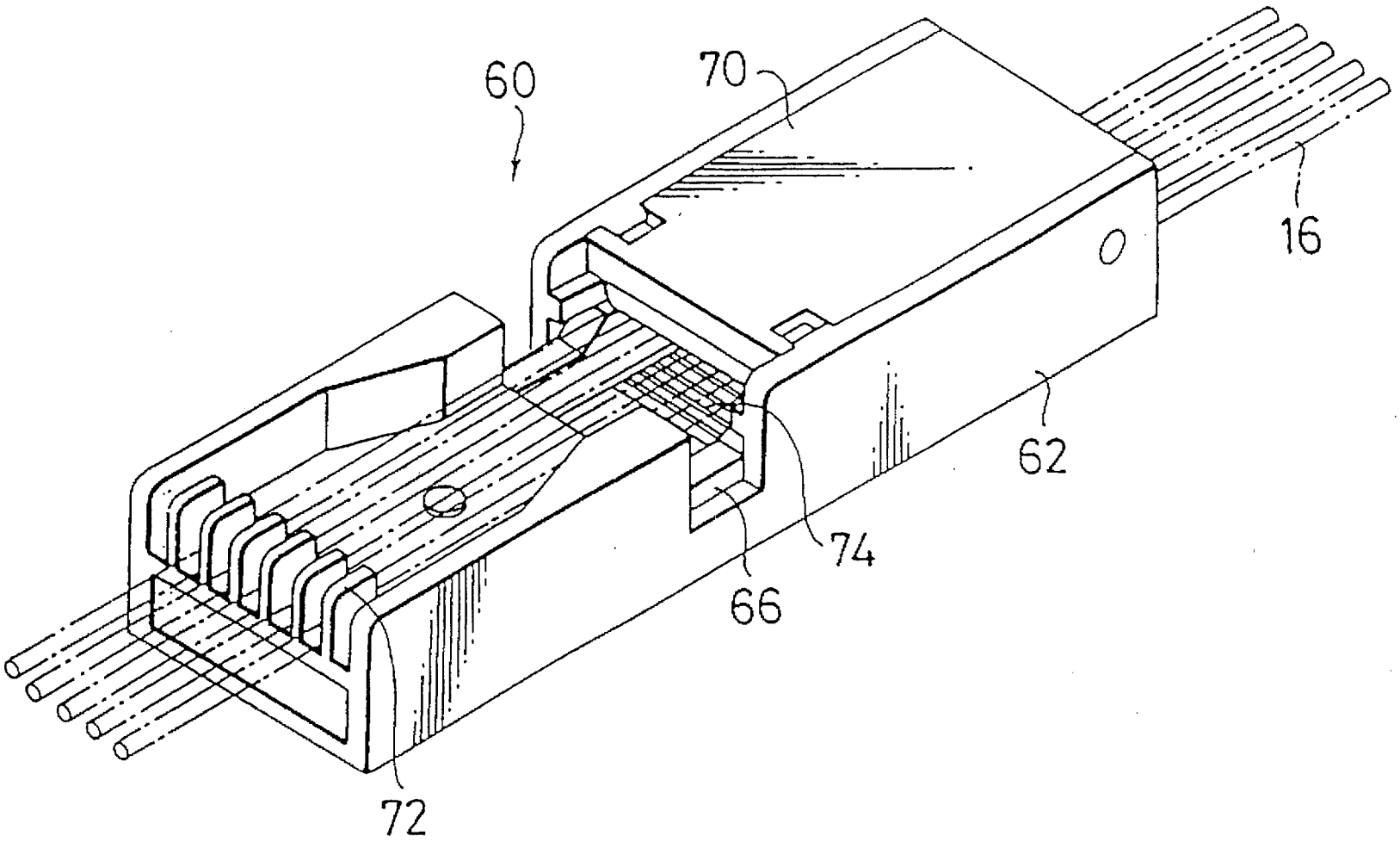
FIG. 11 is a perspective view showing a pull cord stopper device according to a second embodiment of the present invention.
Figure 12:
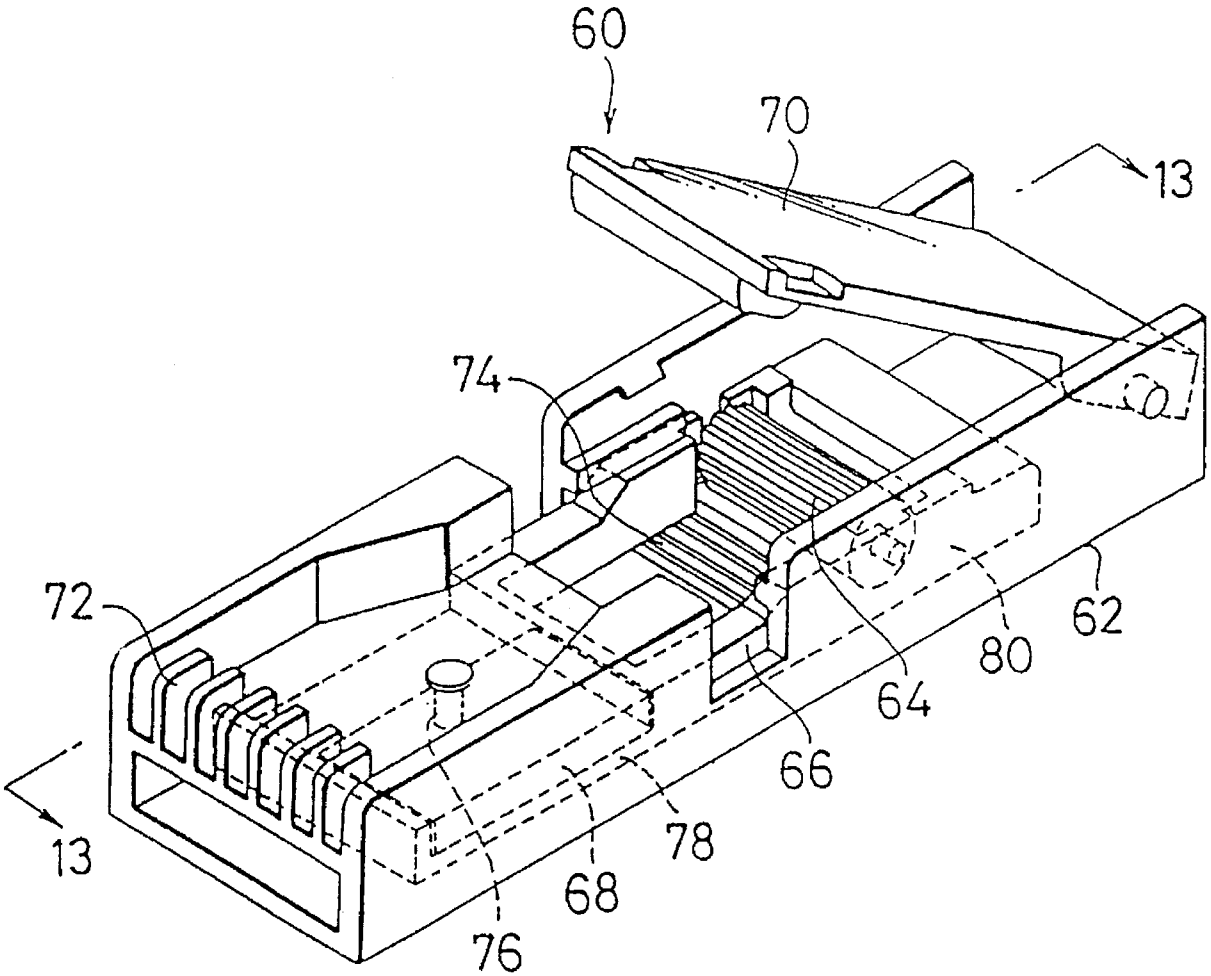
FIG. 12 is a perspective view showing the pull cord stopper device of FIG. 11 with its pressure member opened.
Figure 13:
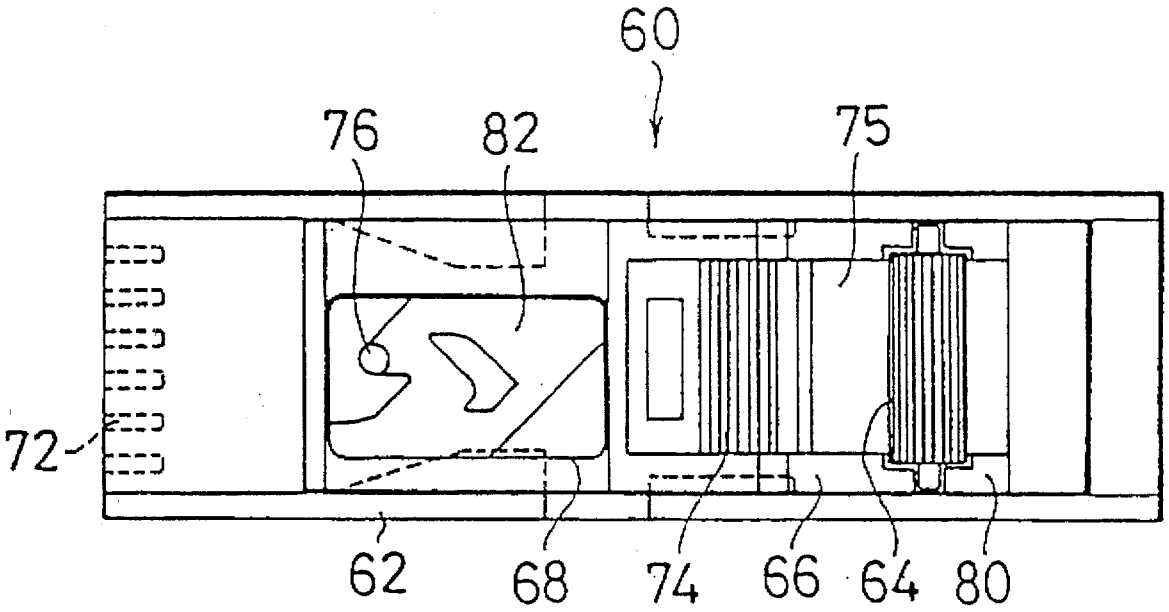
FIG. 13 is a cross-sectional view taken along line 13—13 in FIG. 12.

FIGS. 11, 12 and 13 show a second embodiment of the present invention. In accordance with this second embodiment, a pull cord stopper device 60 comprises a stopper case 62, a pinch roller 64, a slidable block 66, a switch member 68, and a pressure member 70. The stopper case 62 has at one end a comb portion 72 with longitudinal recesses and longitudinal projections.

As shown in FIG. 11, the comb portion 72 separates pull cords 16 by allowing each cord to pass through a corresponding recess. The stopper case 62 has on its inside bottom surface a knurled portion 74 where transversely extending sawtooth projections are provided. The sawtooth projections on the knurled portion 74 are meshed with circumferential sawteeth provided on the pinch roller 64.

Referring to FIGS. 12–17, the stopper case 62 includes on its bottom surface a cutout portion 75. The stopper case 62 also includes a pin 76 which extends downward from its upper surface.

The slidable block 66 comprises a support 78 that supports the switch member 68 in a manner which allows the switch member 68 to move in a direction perpendicular to the direction of the movement of the slidable block 66, arm portions 80 that rotatably support the pinch roller 64, and a contact portion 81 which transversely connects the ends of the arm portions 80 and which has a curved face on its underside so that the pull cords 16 are guided thereunder.

The slidable block 66 is mounted inside the stopper case 62 such that the support 78 is positioned near the pin 76 and the arm portions 80 are positioned near the knurled portion 74 of the stopper case 62. The pinch roller 64 is engaged with the knurled portion 74, where the pinch roller's sawtooth circumference is meshed with sawtooth projections of the knurled portion 74. When rotated, the pinch roller 64 along with the slidable block 66 moves in its longitudinal direction according by means of the knurled portion 74.

As shown in FIG. 13, the switch member 68 has a guide groove 82 on its surface. The switch member 68 is placed on the support 78 such that the guide groove 82 faces upward. The guide groove 82 receives the pin 78 such that the switch member 68 is guided by the pin 78.

Figure 14:
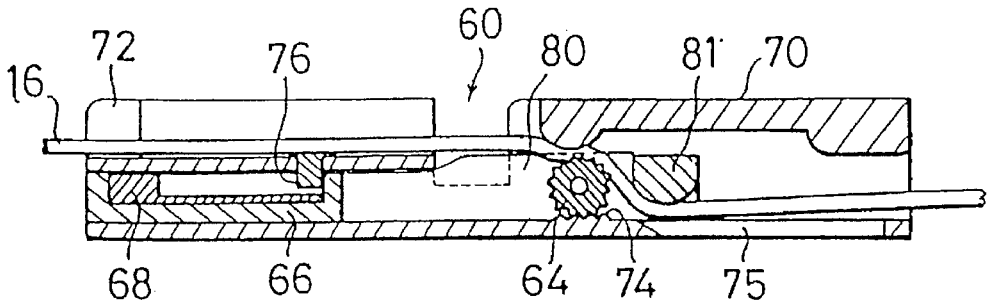
FIG. 14 is a cross-sectional view showing a pull cord stopper device that restrains movement of pull cords.

Referring to FIGS. 11–12, the pressure member 70 is pivotally attached to the stopper case 62 at one end. The pressure member 70 extends longitudinally along the stopper case 62 such that its other end is positioned above the knurled portion 74. As shown in FIG. 14, when the pinch roller 64 reaches the leftward end of the knurled portion 74, the pressure member 70 pinches the pull cords 16 to restrain their movement.

The pull cords 16 are introduced into the stopper case 62 by routing each cord through a recess of the comb portion 72, then along a top surface of the stopper case 62 and the pinch roller 64, and then under a curved face of the contact portion 81. The pull cords 16 extend out of the stopper case 62 at a slightly upward inclination.

The operation of the second embodiment is now discussed.

Figure 18:
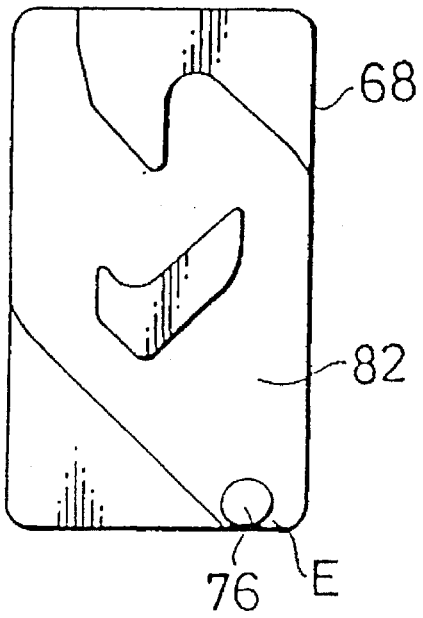
FIG. 18 is a view showing a pin which is located at position E in a guider groove of a switch member.

Referring to FIG. 18, when the blind apparatus 11 is stationary, the slidable block 66 of the pull cord stopper 60 is restrained by switch member 68 which is is locked at position E by the pin 76 which is positioned in guide groove 82. When in this state, as shown in FIG. 14, the slidable block 66 is positioned to the left of the pull cord stopper 66. The pinch roller 64 is positioned at the left end of the knurled portion 74 pinching the pull cords 16 against the pressure member 70.

When the control string 24 is manually pulled downward, the pull cords 16 move rightward thereby causing the pinch roller 64 to rotate clockwise, and move rightward through the knurled portion 74. Along with the pinch roller 64, the slidable block 66 also moves rightward. When the pinch roller 64 is disengaged from the knurled portion 74 and proceeds into the cutout 75, it begins to idly rotate. When the pinch roller 64 idly rotates, the contact portion 81 continues to move rightward because of its contact with the pull cords 16. Thus, the slidable block 66 along witch the pinch roller 64 moves rightward.

Figure 15:
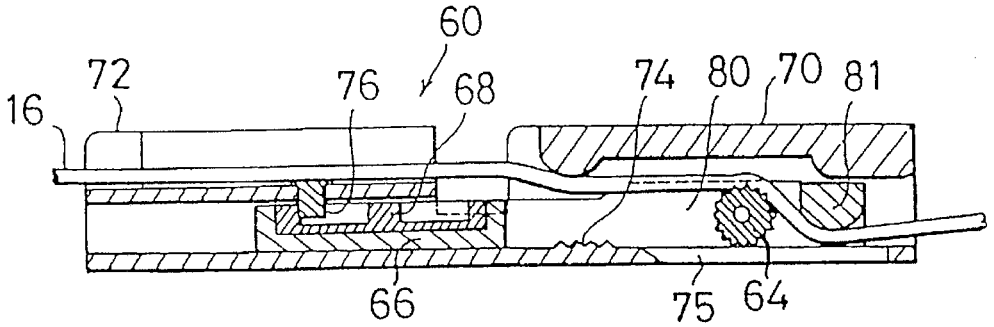
FIG. 15 is a cross-sectional view showing a pull cord stopper device that allows movement of pull cords.
Figure 19:
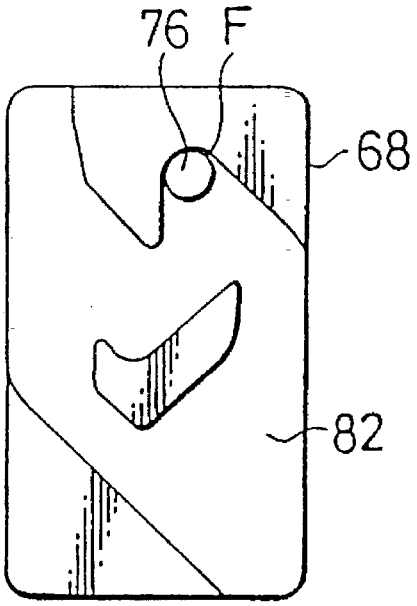
FIG. 19 is a view showing a pin which is located at position F in a guide groove of a switch member.

The rightward movement of the slidable block 66 causes the switch member 68 to move rightward and upward as well until, as shown in FIG. 19, the pin 76 reaches position F of the guide groove 82. When the pin 76 reaches the position F of the guide groove 82, the rightward movement of the switch member 68 is restrained. Then, as shown in FIG. 15, the slidable block 66 and the pinch roller 64 prevented from moving any further to the right. When this occurs, the pull cords 16 are not pinched between the pinch roller 64 and the pressure member 70. As a result, the control string 24 can be continuously pulled and the screen 12 can be raised.

Figure 20:
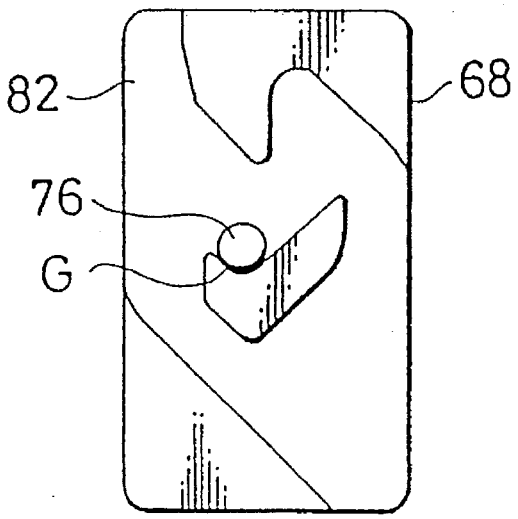
FIG. 20 is a view showing a pin which is located at position G in a guide groove of a switch member.

When the user releases his or her hold of the control string 24, the pull cords 16 move leftward because of the mass of the bottom weight 14. Referring to FIG. 15, when this occurs the contact portion 81, as a result of its curved face which is positioned opposite the pinch roller 64, provides a slightly forced contact with the pull cords 16. This contact provides friction with the pull cords 16, causing the contact portion 81 to move leftward. The idling pinch roller 64 along with the slidable block 66 are also moved leftward. Along with the slidable block 66, the switch member 68 moves leftward and upward as well until, as shown in FIG. 20, the pin 76 reaches position G of the guide groove 82. When the pin 76 reaches position G of the guide groove 76, the leftward movement of the switch member 68 is restrained, and the slidable block 66 cannot continue its leftward movement.

Figure 16:
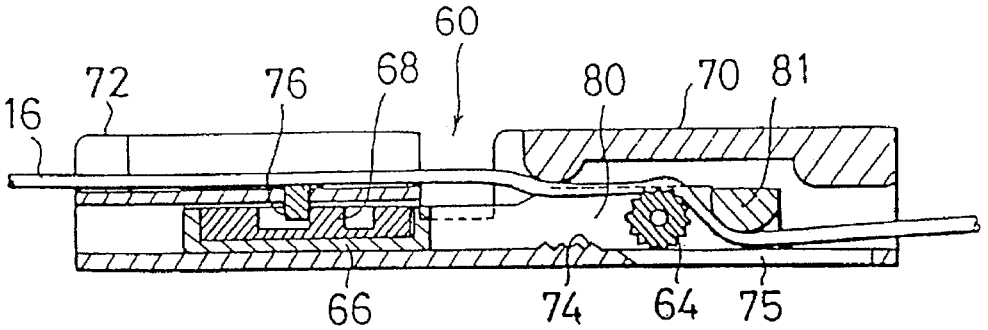
FIG. 16 is a cross-sectional view showing another state of a pull cord stopper device that allows movement of pull cords.

When this occurs the slidable block 66 and the pinch roller 64 stop as shown in FIG.16. The pinch roller 64 is in the space of the cutout 75, and the pull cords 16 are not pinched between the pinch roller 64 and the pressure member 70. The pull cords 16 are free to move and continuously move leftward by the mass of the bottom weight 14 such that the screen 12 is lowered.

Figure 17:
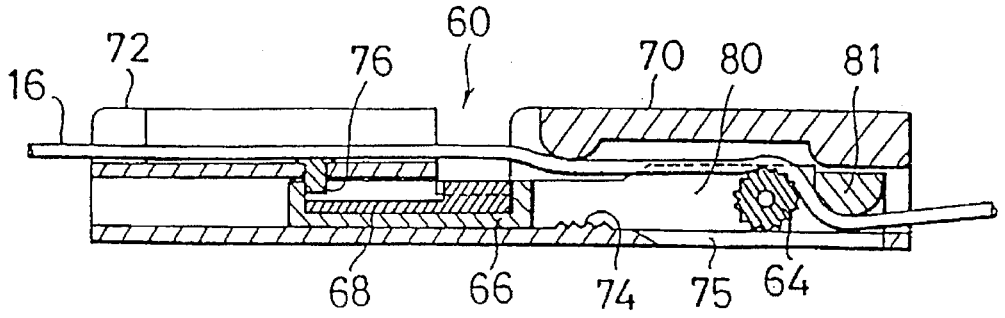
FIG. 17 is a cross-sectional view showing yet another state of a pull cord stopper device that allows movement of pull cords.
Figure 21:
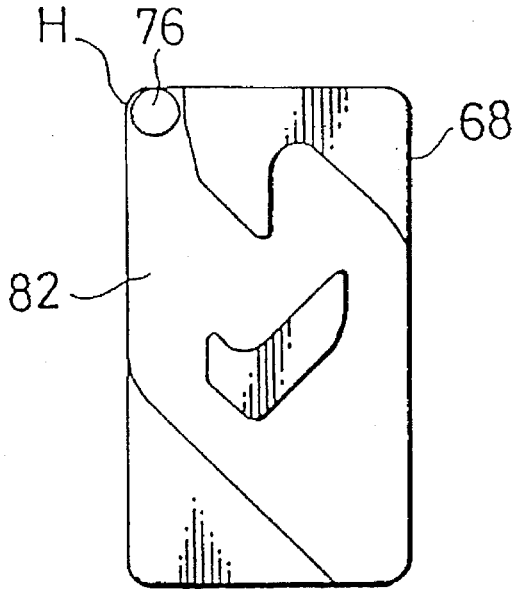
FIG. 21 is a view showing a pin which is located at position H in a guide groove of a switch member.

Again referring to FIG. 16, when the control string 24 is manually pulled downward again, the pull cords 16 move rightward. The contact portion 81 moves rightward, and the pinch roller 64, while rotating idly, moves rightward along with the slidable block 66. The rightward movement of the slidable block 66 causes the switch member 68 to move rightward and upward as well until, as shown in FIG. 21, the pin 76 reaches a position H in the guide groove 82. As shown in FIG. 17, when the pin 76 reaches the position H of the guide groove 82, the rightward movement of the slidable block 66 is restrained, and the slidable block 66 is stopped.

When the user releases his or her hold of the control string 24, the pull cords 16 move leftward because of the mass of the bottom weight 14. The contact portion 81 moves leftward, and thus the pinch roller 64, while rotating idly, moves leftward along with the slidable block 66. Along with the slidable block 66, the switch member 68 moves leftward and downward as well until, as shown in FIG. 18, the pin 76 reaches position E of the guide groove 82.

When this occurs, the pinch roller 64, while rotating idly in the space of the cutout 75, moves leftward to the knurled portion 74. Thereafter, the pinch roller 64 continues to move leftward over the knurled portion 74. When the pin 76 reaches the position E of the guide groove 76, the leftward movement of the switch member 68 is restrained, and the slidable block 66 cannot continue its leftward movement. As shown in FIG. 14, when this occurs, the slidable block 66 and the pinch roller 64 are stopped. Since the pinch roller 64 is positioned at the end of the knurled portion 74, the pull cords 16 are pinched between the pinch roller 64 and the pressure member 70. As a result, the movement of the pull cords 16 is restrained, and the bottom weight 14 stops midway.

As described above, the pull cord stopper device 60 can switch between engagement and disengagement of the pull cords 16 depending on the number of times the control string has been pulled.

Figure 22:
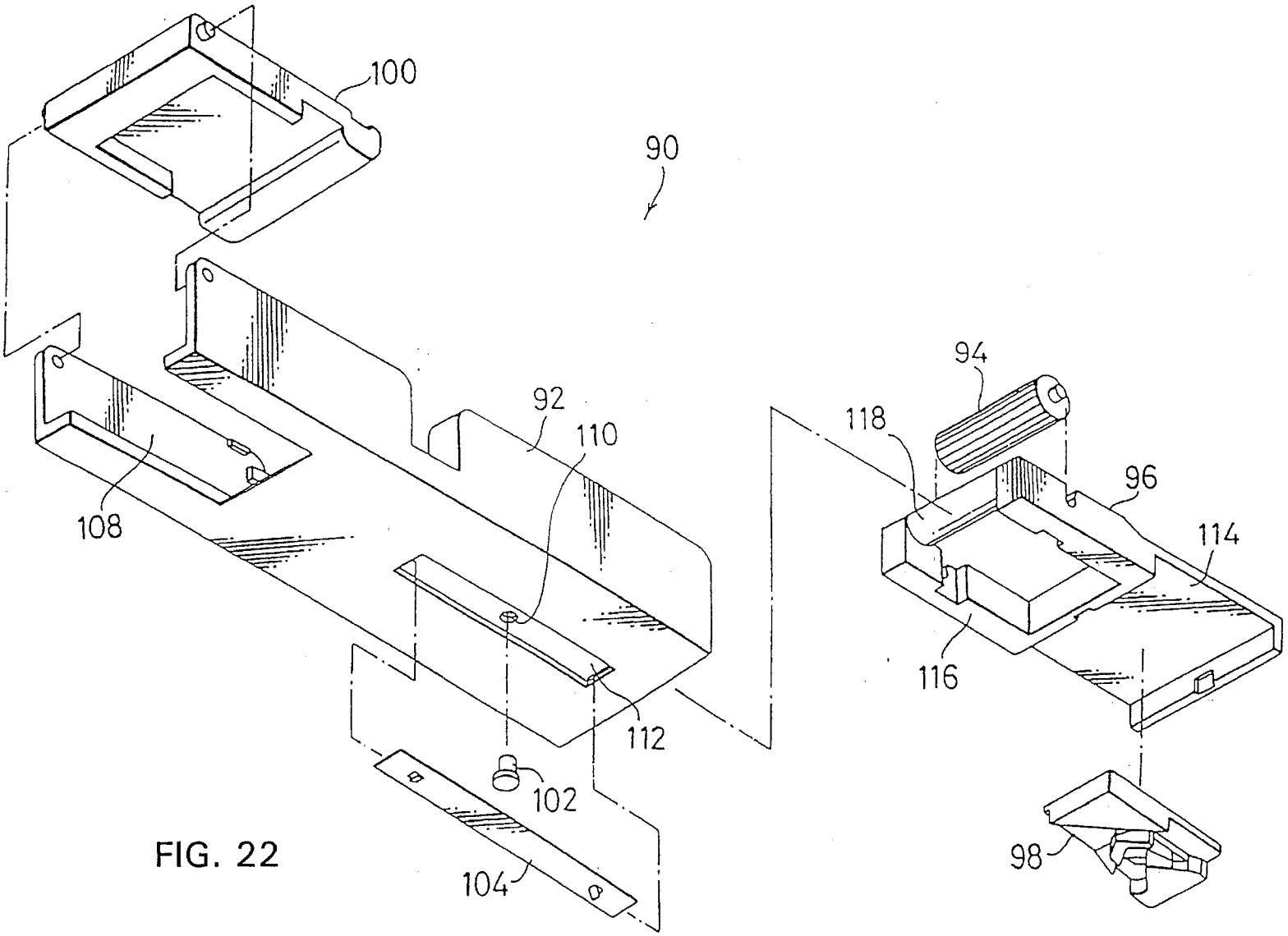
FIG. 22 shows a pull cord stopper device according to a third embodiment of the present invention.

FIG. 22 shows a third embodiment of the present invention. A stopper device 90 comprises a stopper case 92, a pinch roller 94, a slidable block 96, a switch member 98, a pressure member 100, a pin 102, and a leaf spring 104. The stopper case 92 has at one end a comb portion, which is not shown, of longitudinally extending recesses and projections in the same manner as in the first embodiment and second embodiment. Each recess allows a pull cord 16 to pass therethrough to separate the pull cords 16.

Figure 23:
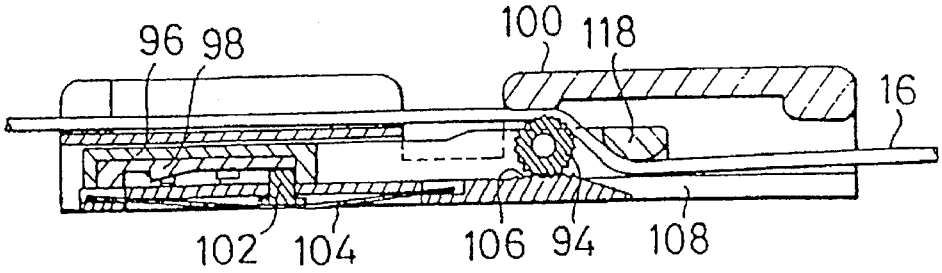
FIG. 23 is a cross-sectional view showing the pull cord stopper device that restrains movement of pull cords.

As shown in FIG. 23, the stopper case 92 has positioned midway on its inner bottom surface a knurled portion 106 where transversely extending sawtooth projections are repeated. The knurled portion 106 is meshed with circumferential sawteeth positioned on the pinch roller 94. The stopper case 92 has on its bottom surface a cutout 108 that extends from an end of the knurled portion 106 to one end of the stopper case 92.

The stopper case 92 has on its bottom surface a through-hole 110 opposite to the cutout 108 with respect to the knurled portion 106. As shown in FIG. 22, the pin 102 is inserted into the through-hole 110 from below the stopper case 92. A longitudinally extending groove 112 is formed on the bottom side of the stopper case 92 where the through-hole 110 is drilled. The leaf spring 104 is fitted into the groove 112 to constantly urge the pin 102 upward.

The slidable block 96 comprises a support 114 that supports the switch member 98 in a manner that allows the switch member 98 to move in a direction transverse to the direction of the movement of the slidable block 96, arm portions 116 for rotatably supporting the pinch roller 94, and a contact portion 118 which transversely connects the ends of the arm portions 116 and which has a curved face on its underside so that the pull cords 16 are guided thereunder.

The slidable block 96 is mounted inside the stopper case 92 and positioned such that its support 114 is adjacent the pin 102 and its arm portions 116 are adjacent the knurled portion 106. As shown in FIG. 23, the pinch roller 94 is engaged with the knurled portion 106, such that the pinch roller's sawtooth circumference is meshed with the sawtooth projections of the knurled portion 106. When rotated, the pinch roller 94 along with the slidable block 96 moves in its longitudinal direction over the knurled portion 106.

Figure 27:
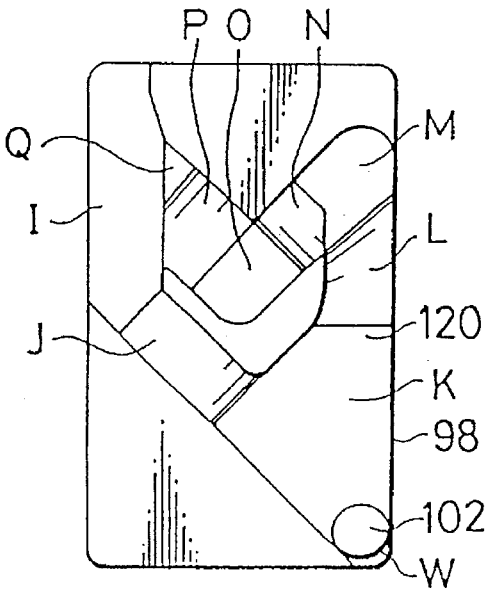
FIG. 27 is a view showing a pin which is located at position W in a guide groove of a switch member.

As shown in FIG. 27, the switch member 98 has a guide groove 120 on its surface. In the groove 120, a portion I is a deep groove portion, a portion J is a ramp groove portion that gradually rises from the portion I to the border between a portion K and the portion I. The portion K is again deep, with a step formed at the border between the portion K and the portion I. A portion L is a ramp portion that gradually rises from the portion K to the border between the portion L and a portion M. The portion M is deep again, with a step formed at the border between the portion L and the portion M. A portion N is a ramp that gradually rises from portion M to the border between the portion N and a portion O. The portion O is again deep, with a step formed at the border between the portion N and the portion O. A portion P is a ramp that gradually rises from the portion O to the border between the portion P and a portion Q, and the portion Q is as shallow as the highest position of the portion P.

As shown in FIG. 23, the switch member 98 is mounted on the support 114 such that the guide groove 120 faces downward in the stopper case 92. The guide groove 120 receives the pin 102 in a manner that allows the switch member 98 to slide. The pin 102 is urged against the switch member 98 by the leaf spring 104 in order to control looseness.

The pressure member 100 is pivotally supported at one end by the stopper case 92 above the cutout 108. The pressure member 100 longitudinally extends along the stopper case 92 such that its other end is positioned above the knurled portion 106 of the stopper case 92.

Referring to FIG. 23, when the pinch roller 94 reaches the left-hand end of the knurled portion 106, the pressure member 100 in cooperation with the pinch roller 94 pinches the pull cords 16 to restrain their movement.

The pull cords 16 are introduced to the stopper case 92 by routing each cord through a corresponding recess of the comb portion. The pull cords 16 are then routed along a top surface of the stopper case 92 and the pinch roller 94, and under a curved face of the contact portion 118. Lastly, the pull cords 16 are delivered out of the stopper case 92 at a slightly upward inclination.

The operation of the third embodiment of the present invention is now discussed.

Referring to FIG. 23, when the blind apparatus 11 is stationary, the slidable block 96 of the pull cord stopper device 90 is positioned toward the left of the stopper case 92. Referring to FIG. 27, while in this position the pin 102 is placed in position W of the guide groove 120 of the switch member 98.

Referring again to FIG. 23, the pinch roller 94 is positioned at the left end of the knurled portion 106, such that the pull cords 16 are pinched against the pressure member 100. When the control string 24 is manually pulled downward, the pull cords 16 move rightward. This causes the pinch roller 94 to rotate clockwise, and move rightward over the knurled portion 106. Along with the pinch roller 94, the slidable block 96 also moves rightward. When the pinch roller 94 rolls out of engagement with the knurled portion 104 and is positioned in the cutout 108, it begins to idly rotate. When the pinch roller 94 idly rotates, the contact portion 118 moves rightward in FIG. 24 because of its frictional contact with the pull cords 16.

Figure 24:
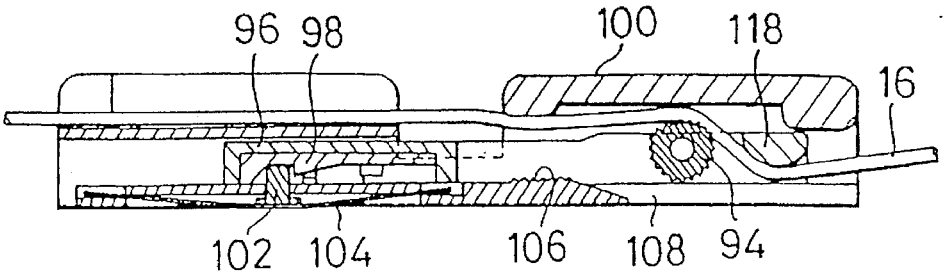
FIG. 24 is a cross-sectional view showing one state of a pull cord stopper device that allows movement of pull cords.
Figure 28:
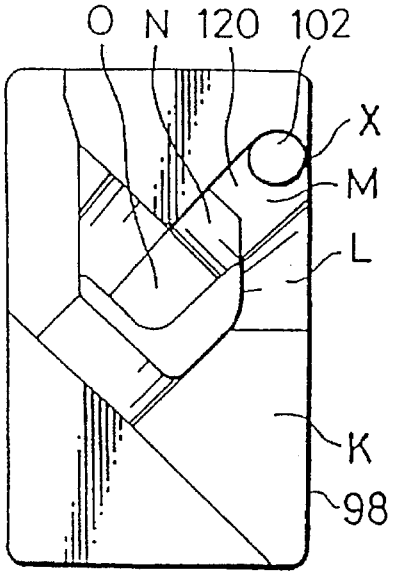
FIG. 28 is a view showing a pin which is located at position X in a guide groove of a switch member.

Thus, as a result of the foregoing, the slidable block 96 along with the pinch roller 94 move rightward to the position shown in FIG. 24. The rightward movement of the slidable block 96 causes the switch member 96 to move rightward until, referring to FIG. 28, the pin 102 goes over the portion L in the guide groove 120 and reaches a position X in the portion M. When the pin 102 reaches the position X of the guide groove 102, the rightward movement of the switch member 98 is restrained. When this occurs, as shown in FIG. 24, the slidable block 96 is prevented from moving further to the right. The slidable block 96 and the pinch roller 94 are also stopped. Given that the pull cords 16 are not pinched between the pinch roller 94 and the pressure member 100, the control string 24 can be continuously pulled downward and the screen 12 can be raised.

Figure 29:
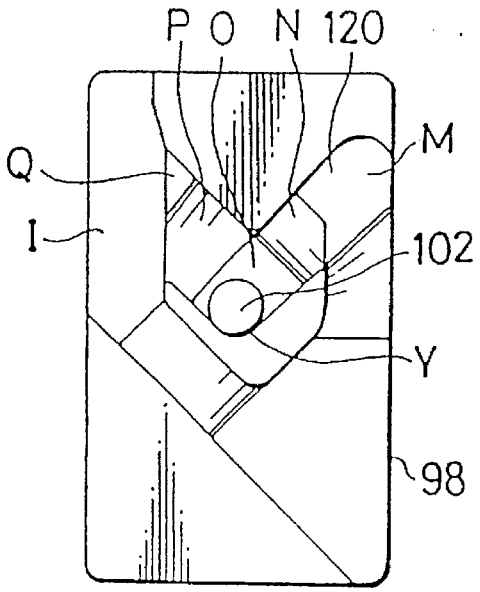
FIG. 29 is a view showing a pin which is located at position Y in a guide groove of a switch member.

Again referring to FIG. 24, when the user releases his or her hold of the control string 24, the pull cords 16 move leftward because of the mass of the bottom weight 14. The contact portion 118 maintains contact with the pull cords 16 along the right half of its curved face opposite the pinch roller 94. This contact provides friction with the pull cords 16, causing the contact portion 118 to move leftward. The pinch roller 94, while idly rotating, moves leftward along with the slidable block 96. Along with the slidable block 96, the switch member 98 moves leftward and at the same time moves perpendicular to this plane of movement until, as shown in FIG. 29, the pin 102 goes over the portion N in the guide groove 120 and reaches a position Y in the portion O in the guide groove 120 in FIG. 29.

Figure 25:
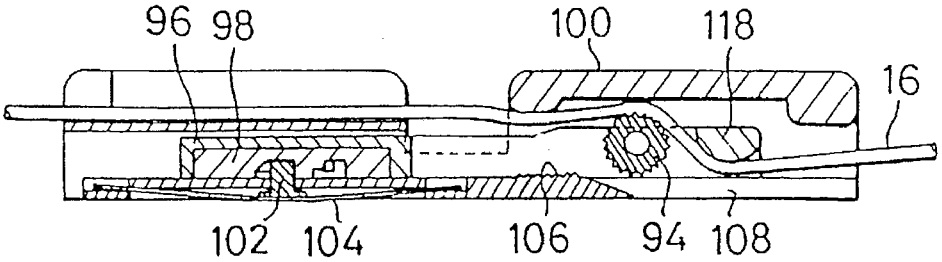
FIG. 25 is a cross-sectional view showing another state of a pull cord stopper device that allows movement of pull cords.

When the pin 102 reaches the position Y of the guide groove 120, the leftward movement of the switch member 98 is restrained and the slidable block 96 cannot continue its leftward movement. When this occurs, the slidable block 96 and the pinch roller 94 stop as shown in FIG. 25. The pinch roller 94 is in the space of the cutout 108, and the pull cords 16 are not pinched between the pinch roller 94 and the pressure member 100. The pull cords 16 are free to move and continuously move leftward by the mass of the bottom weight 14. The screen 12 is thus continuously lowered.

Figure 26:
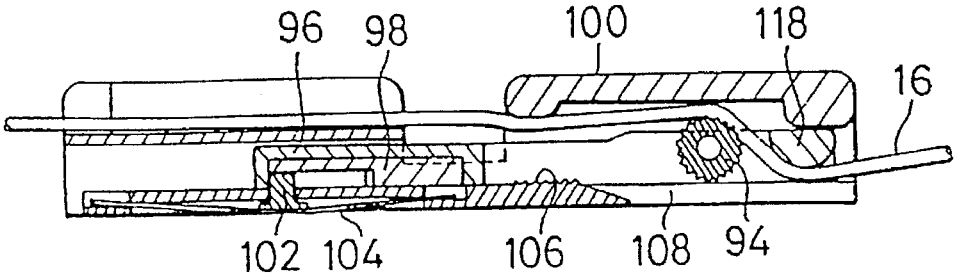
FIG. 26 is a cross-sectional view showing yet another state of a pull cord stopper device that allows movement of pull cords.
Figure 30:
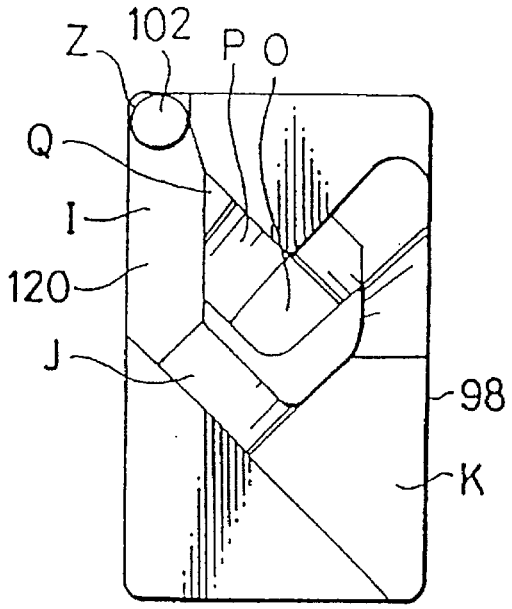
FIG. 30 is a view showing a pin which is located at position Z in a guide groove of a switch member.

Referring to FIG. 25, when the control string 24 is manually pulled downward again, the pull cords 16 move rightward. When this occurs, the contact portion 118 moves rightward, and the pinch roller 94, while rotating idly, moves rightward along with the slidable block 96. The rightward movement of the slidable block 96 causes the switch member 98 to move rightward and at the same time moves perpendicular to the plane of movement until, referring to FIG. 30, the pin 102 goes over portion P and reaches position Z in portion I of the guide groove 120. When the pin 102 reaches the position Z of the guide groove 102, as shown in FIG. 26, the rightward movement of the slidable block 96 is restrained and the slidable block 96 is stopped.

When the user releases his or her hold of the control string 24, the pull cords 16 move leftward because of the mass of the bottom weight 14. The contact portion 118 moves leftward and the pinch roller 94, while rotating idly, moves leftward along with the slidable block 96. Along with the slidable block 96, the switch member 98 also moves leftward and at the same time moves perpendicular to the plane of movement until, as shown in FIG. 27, the pin 102 goes over the portion J in the guide groove 120 and reaches a position W in the portion K in the guide groove 120. The pinch roller 94, while rotating idly in the space of the cutout 108, moves leftward and reaches the knurled portion 106. Thereafter, the pinch roller 94 continues to move leftward over the knurled portion 106. When the pin 102 reaches the position W of the guide groove 120, the leftward movement of the switch member 98 is restrained, and the slidable block 96 and the pinch roller 94 cannot continue their leftward movement. As shown FIG. 23, the slidable block 96 and the pinch roller 94 are then stopped. Since the pinch roller 94 is positioned at the end of the knurled portion 106, the pull cords 16 are pinched between the pinch roller 94 and the pressure member 100. The movement of the pull cords 16 is restrained, and the bottom weight 14 is stopped.

As described above, the pull cord stopper device 90 can switch between engagement and release of engagement of the pull cords 16 depending on how many times the control string has been pulled.

In both the first and second embodiments, the depth of the guide groove of the switch member is constant in any location within, and in the third embodiment, the depth of the guide groove of the switch member is varied. The present invention is not limited to these embodiments given that other forms of the guide groove can be used.

In these embodiments, the comb portion that separates the pull cords is disposed on the entry side of the stopper case. Alternatively, it may be disposed on the exit side of the stopper case, or two comb portions may be disposed, one for each of the entry and exit sides.

Since the present invention employs the arrangement in which the switching of the pull cords between an engaged and disengaged position is performed by horizontally moving the pinch roller, a reduced height dimension is possible in the pull cord stopper device. Thus, the pull cord stopper device according to the present invention can be easily installed in the head box.

Since the pull cord stopper device is operated by pulling the control string, its operation is simple, as compared to conventional devices in which the control string needs to be positioned horizontally before raising or lowering the blind. Since a compact exit opening of the pull cords is allowed, the present invention additionally offers an aesthetically pleasing appearance. The pressure member is detachably mounted into the stopper case, and thus routing the pull cords is easily performed as well.

In the second and third embodiments, the knurled portion is disposed where the pull cords are pinched between the pinch roller of the stopper case and the pressure member, and the cutout is disposed along a path of the pinch roller. When the control string is pulled down to raise the screen, the pinch roller simply rotates idly in the cutout portion. Thus, wear of the pull cords is prevented thus providing a device with a long service life.

Fourth and fifth embodiments of the present invention are now described. The fourth and fifth embodiments are characterized in that a separation between the stopper device and the cord exit opening of the head box is adjustable in the head box. These embodiments also have a comb member between the stopper device and the exit opening for separated the pull cords from one another.

When the number of pull cords is large, a pull cord stopper device is installed apart from the pull cord exit opening of the head box. With a bottom weight near its lowest position, the cord binder comes close to the cord exit opening. As a result, the pull cords may get tangled near the cord binder. Even if the pull cords have a tangled portion formed at the pull cord exit opening, however, that portion may be disentangled before it reaches the stopper device. Therefore, entangled cords are not introduced into the stopper device.

When the number of pull cords is small, the stopper device may be installed close to the cord exit opening. When the cord binder gets near the pull cord exit opening, the pull cords may get still get tangled. However, when this occurs, the tangled portion is of short-length and easily rapidly disentangled. Therefore, when the number of pull cords is small, entangled cords are not introduced into the stopper device.

The comb portion of the fourth and fifth embodiment is disposed between the stopper device and the pull cord exit opening. This prevents entangled cords from getting jammed in the comb member.

Figure 31:
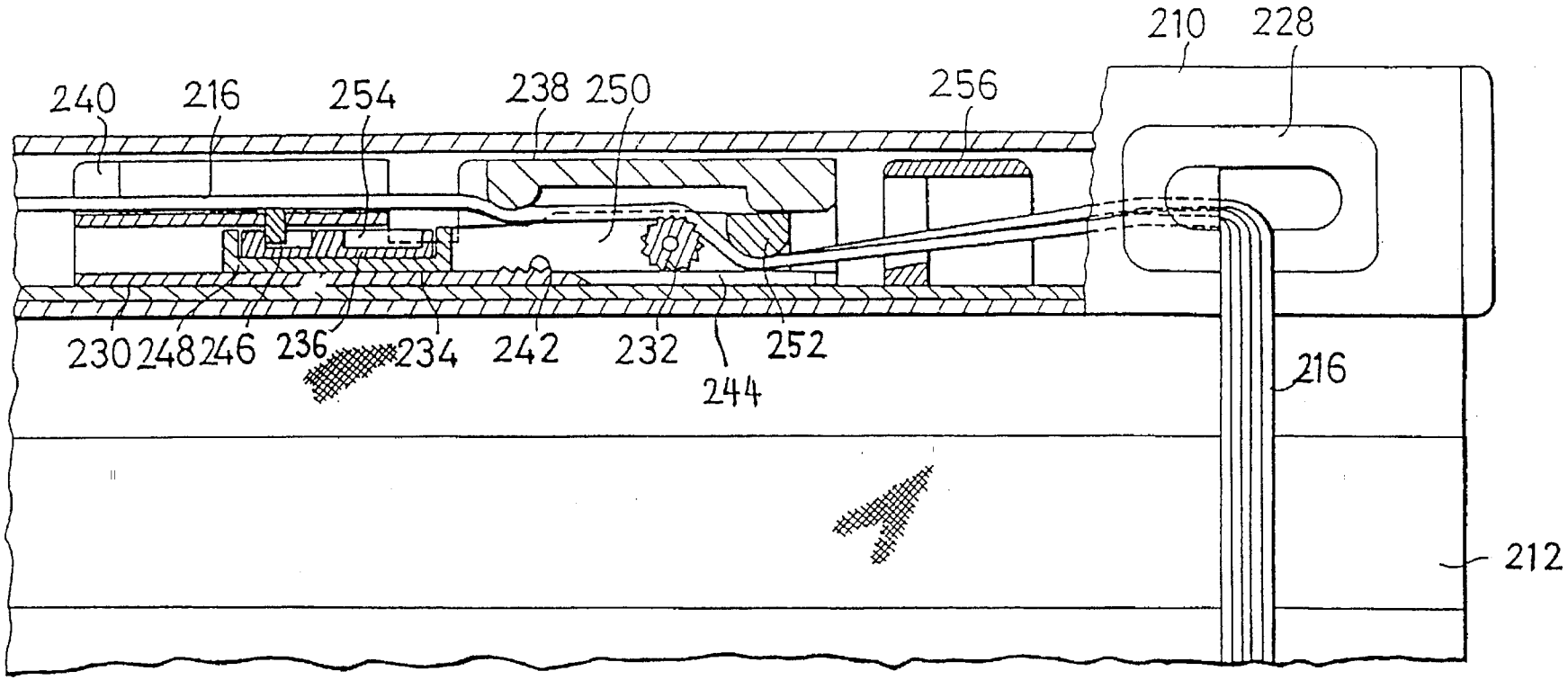
FIG. 31 shows a head box of a pull cord stopper device, according to a fourth embodiment of the present.
Figure 32:
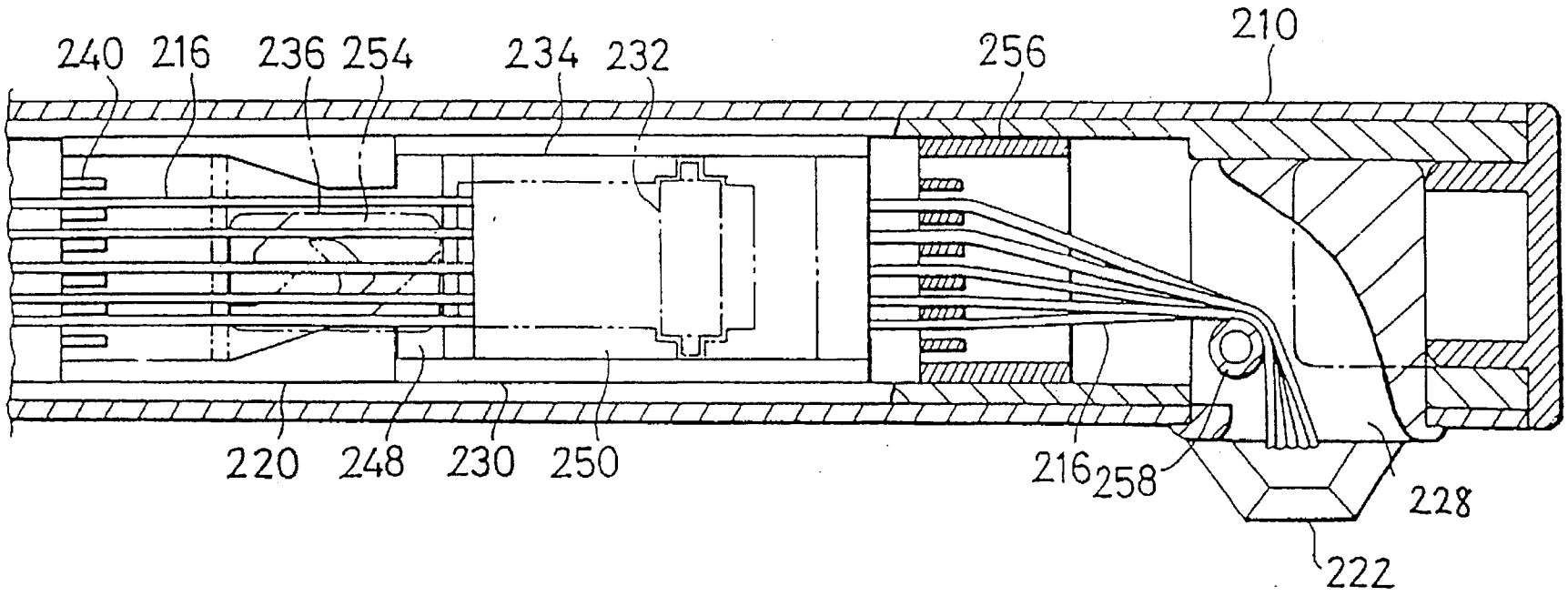
FIG. 32 is a horizontal cross-sectional view showing an interior of a head box.

FIGS. 31 and 32 show part of the head box 210 from the mounting position of the pull cord stopper device 220 to the pull cord exit opening 228. The stopper device 220 comprises a stopper case 230, a pinch roller 232, a slidable block 234, a switch member 236 and a pressure member 238. The stopper case 230 has on its one end portion a comb portion 240 of longitudinally extending recesses and projections. As shown in FIG. 32, each recess of the comb portion 240 allows a pull cord 216 to pass therethrough and separates the pull cords 216.

The stopper case 230 has positioned midway on its inner bottom surface a knurled portion 242 with transversely extending sawtooth projections. The knurled portion 242 is meshed with the sawtooth projections on a circumference of the pinch roller 232. The stopper case 230 has on its bottom surface a cutout 244 that extends from the end of the knurled portion 242 to one end of the stopper case 230.

Referring to FIG. 31, the stopper case 230 is provided with a pin 246 that is projected downward. The slidable block 234 comprises a support 248 that supports the switch member 236 in a manner that allows the switch member 236 to move in a direction transverse to the direction of the movement of the slidable block 236, arm portions 250 for rotatably supporting the pinch roller 232, and a contact portion 252 which transversely connects the ends of the arm portions 250 and which has a curved face on its underside so that the pull cords 216 are guided thereunder.

The slidable block 234 is mounted inside the stopper case 230 in a manner that its support 248 is adjacent to the comb portion 240 and its arm portions 250 are adjacent to the knurled portion 242. The pinch roller 232 is engaged with the knurled portion 242, with the pinch roller's sawtooth circumference meshed with sawtooth projections of the knurled portion 242. When rotated, the pinch roller 242 along with the slidable block 234 moves in its longitudinal direction over the knurled portion 242.

Referring to FIG. 31, the switch member 236 has a guide groove 254 on its surface and is mounted on the support 248, where the guide groove 254 faces upward relative to the stopper case 230. The guide groove 254 receives the pin 246 in a manner that allows the switch member 236 to slide.

The pressure member 238 is pivotally supported at one end by the stopper case 230. The pressure member 238 extends longitudinally across the stopper case 230 such that its other end is positioned above the knurled portion 242. When the pinch roller 232 reaches the left-hand end of the knurled portion 242, the pressure member 238 in cooperation with the pinch roller 232 pinches the pull cords 216 to restrain their movement.

The pull cords 216 are first introduced by the comb portion 240 into the stopper case 230 by routing each cord through the corresponding recess of the comb portion 240, then routed on the top surface of the stopper case 230 and the pinch roller 232, and then under the contact portion 252 along its curved face. The pull cords 216 extend out of the stopper case 230 at a slightly upward inclination.

The comb member 256 is disposed between the pull cord stopper device 220 and the pull cord exit opening 228. Like the comb portion 240 in the pull cord stopper device 220, the comb member 256 has also longitudinally extending recesses and projections which allow each pull cord to pass therethrough to separate the pull cords 216. The comb member 256 is particularly useful when a large number of cords 216 are used.

The pull cords 216 passing through the comb member 256 are routed through a guide roller 258 disposed near the cord exit opening 228 inside the head box 210. The guide roller 258 changes the direction of the pull cords 256 to deliver them out of the pull cord exit opening 228.

The pull cord stopper device 220 may be alternatively designed. In particular, the pin disposed into the stopper case 230 may be supported by a spring and projected from a bottom side of the pull cord stopper device. Also, the support 248 of a switch member can be designed so that a guide groove of the switch member faces downward relative to the stopper case 230. Additionally, the guide groove may be provided with a step to regulate the sliding motion of the slidable block by preventing the pin from sliding back.

The operation of the fourth embodiment of the present invention is now discussed.

Referring to FIG. 31, the pinch roller 232 of the pull cord stopper device 220 is positioned at the left end of the knurled portion 242, and pinches the pull cords 216 against the pressure member 238.

When the control string 24 is pulled downward, the pull cords 216 move rightward. This causes the pinch roller 232 to rotate clockwise, and move rightward over the knurled portion 242. Along with the pinch roller 232, the slidable block 234 also moves rightward. When the pinch roller 232 is disengaged from the knurled portion 242 and is positioned in the cutout 242, it begins to idly rotate. When the pinch roller 232 idly rotates, the contact portion 252 is drawn rightward because of its contact with the pull cords 216. Thus, the slidable block 234 along with the pinch roller 232 are moved rightward.

The rightward movement of the slidable block 234 causes the switch member 236 to move rightward until the pin 246 reaches the predetermined position in the guide groove 254. When the pin 246 reaches the predetermined position in the guide groove 254, the rightward movement of the switch member 236 is restrained. When this occurs, the slidable block 234 cannot move any further to the right. The slidable block 234 and the pinch roller 232 are therefore stopped. When this occurs, the pull cords 216 are not pinched between the pinch roller 232 and the pressure member 238, and the control string 24 can be continuously pulled downward.

A plurality of pull cords 216 sliding in the head box 210 are first separated from one another through the comb portion 240 in the stopper device 220, then routed along the pinch roller 232 and under the contact portion 252, delivered out of the stopper device 220, again separated one from another through the comb member 256, guided by the guide roller 258 toward the pull cord exit opening 228, and then routed out of the head box 210 through the exit opening 228. The screen 12 is thus raised.

When the user releases his or her hold of the control string 24, the pull cords 216 move leftward because of the mass of the bottom weight 14. The contact portion 252 contacts the pull cords on a right half of its curved face opposite the pinch roller 232 side. This contact with the pull cords 216 causes the contact portion 252 to move leftward.

The pinch roller 232, while idly rotating, moves leftward along with the slidable block 234. Along with the slidable block 234, the switch member 236 moves leftward until the pin 246 reaches to a predetermined position in the guide groove 254. When the pin 246 reaches the predetermined position in the guide groove 254, the leftward movement of the switch member 236 is restrained, and the slidable block 234 cannot continue its leftward movement any further. The slidable block 234 and the pinch roller 232 are therefore stopped.

When this occurs, the pinch roller 232 is in the space of the cutout 244, and the pull cords 216 are not pinched between the pinch roller 232 and the pressure member 238. The pull cords 216 are free to move, and continuously move leftward by the mass of the bottom weight 14.

A plurality of pull cords 216 sliding in the head box 210 are first separated one from another through the comb portion 240 in the stopper device 220, then routed along on the pinch roller 232 and under the contact portion 252, delivered out of the stopper device 220, again separated one from another through the comb member 256, guided by the guide roller 258 toward the pull cord exit opening 228, and then routed out of the head box 210 through the exit opening 228. The screen 12 is thus lowered.

That portion of the pull cords 216 extending out of the exit opening 228 is then pulled into the head box via the exit opening 228. The pull cords 216 are then routed by the guide roller 258 toward the comb member 256, separated by the comb member 256 and routed through the pull cord stopper 220. The screen 12 is thus continuously lowered. When the bottom weight 14 is lowered almost to its lower limit, the cord binder 22 is raised close to the pull cord exit opening 228. Although the pull cords 216 may get tangled in the vicinity of the cord binder 22, they are disentangled in the travel between the exit opening 228 and the comb member 256. This travel is long enough to disentangle the pull cords 216, and it is not likely that the tangled pull cords 216 will get jammed.

When the control string 24 is pulled downward again, the pull cords 216 move rightward. The contact portion 252 moves rightward, and the pinch roller 232, while rotating idly, moves rightward along with the slidable block 234. The rightward movement of the slidable block 234 causes the switch member 236 to move rightward until the pin 246 reaches a predetermined position in the guide groove 254. When the pin 246 reaches the predetermined position in the guide groove 254, the rightward movement of the slidable block 234 is restrained. When this occurs, the slidable block 234 is stopped. In this state, the control string 24 can be pulled down, and the screen 12 can thus be raised.

When the user releases his or her hold of the control string 24, the pull cords 216 move leftward as a result of the mass of the bottom weight 14. The contact portion 252 moves leftward, and the pinch roller 232, while rotating idly, moves leftward along with the slidable block 234. Along with the slidable block 234, the switch member 236 moves leftward until the pin 246 reaches a predetermined position in the guide groove 254. The pinch roller 232, while rotating idly in the space of the cutout 244, moves leftward and reaches the knurled portion 242. Thereafter, the pinch roller 232 continues to move leftward over the knurled portion 242. When the pin 246 reaches the predetermined position in the guide groove 254, the leftward movement of the switch member 236 is restrained, and the slidable block 234 and the pinch roller 232 cannot continue their leftward movement any further. The slidable block 234 and the pinch roller 232 are therefore stopped. Since the pinch roller 232 is positioned at the end of the pressure member 238, the pull cords 216 are pinched between the pinch roller 232 and the pressure member 238. The screen thus stops midway.

Figure 33:
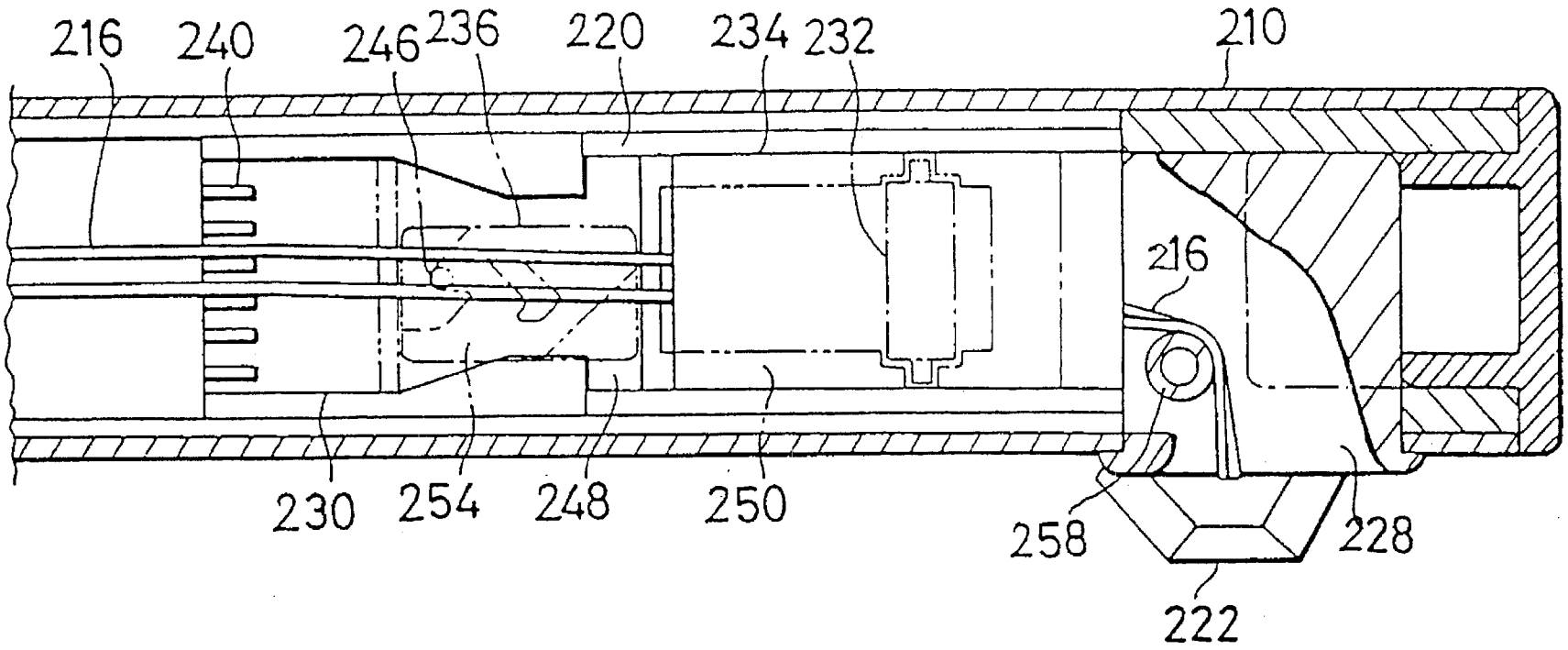
FIG. 33 shows a head box of a pull cord stopper device, according to a fifth embodiment of the present invention.

FIG. 33 shows a fifth embodiment of the present invention. The fifth embodiment is identical to the fourth embodiment in construction except that the comb member 256 is removed from between the pull cord stopper device 220 and the pull cord exit opening 228 and that the pull cord stopper device 220 is installed closer to the pull cord opening 228. The embodiment is particularly useful when a small number of pull cords 216 are used.

When the number of pull cords 216 being used is small, the possibility of tangling is small. If tangled, the cords may be can easily be untangled. Even if tangling occurs widen the the stopper device 220 is mounted close to the pull cord exit opening 228, the tangled portion of the cords 216 is disentangled before it reaches the pull cord stopper device 220. The operation of the present embodiment is identical to the fourth embodiment except for use of the comb member 256.

According to the present invention, the user can easily operate the pull cord stopper device by simply pulling or releasing his or her hold of the cord control string even if the screen is not cleared of obstacles in front or on the side thereof.

Furthermore, according to the present invention, the stopper case is designed to operate the pull cords on the same plane or on a flush level. Therefore, the larger the number of cords the larger the resulting frictional surface. As a result, the sliding motion of the slidable block and switching operation of the switch member are performed in an assured manner. The present invention is thus adaptable to large-scale blind apparatus designs.

What is claimed is:

1. A pull cord stopper device for use in a blind apparatus including:

a head box;

a screen, a top of which is connected to the head box;

a plurality of pull cords, where a first end of each pull cord is connected to a bottom end of the screen, and a second end of each pull cord is inserted into a first opening of the head box and removed from a second opening of the head box; and a pull cord stopper device capable of restraining movement of the pull cords;

said pull cord stopper device comprising:

a stopper case, a pinch roller, a slidable block, a switch member and a pressure member;

said stopper case comprising:

a separation portion for separating the pull cords a knurled portion for guiding movement of the pinch roller; and a pin which is received by a guide groove formed on the switch member for guiding the switch member;

whereby said slidable block rotatably supports the pinch roller and is operative to move in a direction of movement of the pull cords by means of rotation of the pinch roller;

said slidable block supports the switch member which is movable with the pull cords in their direction of movement, and movable in a direction transverse to the movement of the pull cords; and said pressure member is operative to pinch the pull cords between the pinch roller and the pressure member.

2. The pull cord stopper device for use in the blind apparatus according to claim 1, wherein a resilient member is provided to place a force on the slidable block and the pull cords are pinched between the pinch roller and the pressure member.

3. The pull cord stopper device for use in the blind apparatus according to any of claim 1, wherein one end of the pressure member is pivotally mounted to the stopper case to allow the the pressure member to be placed in one of an opened position and a closed position.

4. A pull cord stopper device for use in a blind apparatus including:

a head box;

a screen, a top of which is connected to the head box;

a plurality of pull cords, where a first end of each pull cord is connected to a bottom end of the screen, and a second end of each pull cord is inserted into a first opening of the head box and removed from a second opening of the head box; and a pull cord stopper device capable of restraining movement of the pull cords;

said pull cord stopper device comprising:

a stopper case, a pinch roller, a slidable block, a switch member and a pressure member;

said stopper case comprising:

a separation portion for separating the pull cords;

a knurled portion for guiding movement of the pinch roller; and a cutout portion for allowing the pinch roller to idly rotate;

whereby said slidable block rotatably supports the pinch roller, and is operative to move in a direction of travel of the pull cords by means of rotation of the pinch roller and contact with the pull cords, said slidable block supports the switch member which is movable with the pull cords in their direction of travel, and movable in a direction transverse to the travel of the pull cords;

said switch member is provided with a guide groove;

said guide groove receives a pin rigidly connected to the stopper case for guiding the movement of the switch member; and said pressure member is operative to pinch the pull cords between the pinch roller and the pressure member.

5. The pull cord stopper device for use in the blind apparatus according to claim 4, wherein said pin is constantly urged by a resilient member toward the guide groove of the switch member.

* * * * *